US009092924B1

(12) United States Patent
Rasmussen et al.

(10) Patent No.: US 9,092,924 B1
(45) Date of Patent: Jul. 28, 2015

(54) DISK-TYPE COIN PROCESSING UNIT WITH ANGLED SORTING HEAD

(71) Applicant: Cummins-Allison Corp., Mt. Prospect, IL (US)

(72) Inventors: James M. Rasmussen, Chicago, IL (US); Marianne Krbec, Wood Dale, IL (US); John R. Blake, St. Charles, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 0 days.

(21) Appl. No.: 13/789,842

(22) Filed: Mar. 8, 2013

Related U.S. Application Data

(60) Provisional application No. 61/695,616, filed on Aug. 31, 2012.

(51) Int. Cl.
*G07D 3/00* (2006.01)
*G07D 9/00* (2006.01)

(52) U.S. Cl.
CPC . *G07D 3/00* (2013.01); *G07D 9/008* (2013.01)

(58) Field of Classification Search
CPC ..... G07D 3/00; G07D 3/14; G07D 3/16; G07D 3/06; G07D 9/008; G07D 11/0003; G07D 11/0081
USPC ..... 453/3, 4, 12, 49, 57; 194/342, 350; 209/1, 2, 509, 552, 617, 621, 654, 666, 209/667
See application file for complete search history.

(56) References Cited

U.S. PATENT DOCUMENTS 2,570,920 A 10/1951 Clough et al. ..... 232/16
2,669,998 A 2/1954 Buchholz ..... 133/8

(Continued)

FOREIGN PATENT DOCUMENTS

CA 2235925 C 11/1995 ..... G07D 9/00
CA 2189330 C 12/2000 ..... G07F 17/42

(Continued)

OTHER PUBLICATIONS

Amiel Industries: AI-1500 'Pulsar' High Performance Sorting and Bagging Machine, 13 pages (date unknown, but prior to Dec. 14, 2000).

(Continued)

*Primary Examiner* — Mark Beauchaine
(74) *Attorney, Agent, or Firm* — Nixon Peabody LLP

(57) ABSTRACT

Currency processing systems, coin processing machines, and methods of sorting batches of coins are presented herein. A currency processing system is disclosed which includes a housing with a coin input area for receiving coins, and one or more coin receptacles stowed inside the housing. A disk-type coin processing unit is operatively coupled to the coin input area and the coin receptacle(s). The coin processing unit includes a rotatable disk for imparting motion to coins received from the coin input area, and a sorting head having a lower surface generally parallel to and at least partially spaced from the rotatable disk. The lower surface forms a plurality of shaped regions for guiding the coins, under the motion imparted by the rotatable disk, to a plurality of exit stations through which the coins are discharged to the coin receptacle(s). The sorting head and the rotatable disk are obliquely angled with respect to the support surface upon which the housing rests.

35 Claims, 8 Drawing Sheets

(56) References Cited

U.S. PATENT DOCUMENTS

| | | | | |
|---|---|---|---|---|
| 2,750,949 | A | 6/1956 | Kulo et al. | 133/8 |
| 2,835,260 | A | 5/1958 | Buchholz | 133/8 |
| 2,865,561 | A | 12/1958 | Rosapepe | 232/7 |
| 3,132,654 | A | 5/1964 | Adams | 133/1 |
| 3,376,970 | A | 4/1968 | Roseberg | 198/40 |
| 3,771,583 | A | 11/1973 | Bottemiller | 160/327 |
| 3,778,595 | A | 12/1973 | Hatanaka et al. | 235/61.7 B |
| 3,916,922 | A | 11/1975 | Prumm | 133/3 R |
| 3,998,237 | A | 12/1976 | Kressin | 133/3 A |
| 3,998,379 | A | 12/1976 | Myers et al. | 229/33 |
| 4,050,218 | A | 9/1977 | Call | 53/167 |
| 4,059,122 | A | 11/1977 | Kinoshita | 133/3 D |
| 4,075,460 | A | 2/1978 | Gorgens | 235/420 |
| 4,124,111 | A | 11/1978 | Hayashi | 194/102 |
| 4,150,740 | A | 4/1979 | Douno | 194/4 C |
| 4,166,945 | A | 9/1979 | Inoyama et al. | 235/379 |
| 4,172,462 | A | 10/1979 | Uchida et al. | 133/3 A |
| 4,179,685 | A | 12/1979 | O'Maley | 340/146.3 H |
| 4,179,723 | A | 12/1979 | Spencer | 361/384 |
| 4,184,366 | A | 1/1980 | Butler | 73/163 |
| 4,197,986 | A | 4/1980 | Nagata | 235/379 |
| 4,208,549 | A | 6/1980 | Polillo et al. | 179/6.3 R |
| 4,228,812 | A | 10/1980 | Marti | 133/3 F |
| 4,232,295 | A | 11/1980 | McConnell | 340/152 R |
| 4,234,003 | A | 11/1980 | Ristvedt et al. | 133/3 |
| 4,249,552 | A | 2/1981 | Margolin et al. | 133/1 R |
| 4,251,867 | A | 2/1981 | Uchida et al. | 364/408 |
| 4,286,703 | A | 9/1981 | Schuller et al. | 194/100 A |
| RE30,773 | E | 10/1981 | Glaser et al. | 235/379 |
| 4,310,885 | A | 1/1982 | Azcua et al. | 364/405 |
| 4,317,957 | A | 3/1982 | Sendrow | 178/22.08 |
| 4,341,951 | A | 7/1982 | Benton | 235/379 |
| 4,355,369 | A | 10/1982 | Garvin | 364/900 |
| 4,360,034 | A | 11/1982 | Davila et al. | 133/3 D |
| 4,369,442 | A | 1/1983 | Werth et al. | 340/825.35 |
| 4,380,316 | A | 4/1983 | Glinka et al. | 232/16 |
| 4,383,540 | A | 5/1983 | DeMeyer et al. | 133/3 H |
| 4,385,285 | A | 5/1983 | Horst et al. | 382/3 |
| 4,412,292 | A | 10/1983 | Sedam et al. | 364/479 |
| 4,416,299 | A | 11/1983 | Bergman | 133/1 R |
| 4,417,136 | A | 11/1983 | Rushby et al. | 235/379 |
| 4,423,316 | A | 12/1983 | Sano et al. | 235/379 |
| 4,434,359 | A | 2/1984 | Watanabe | 235/379 |
| 4,436,103 | A | 3/1984 | Dick | 133/3 D |
| 4,444,212 | A * | 4/1984 | Ristvedt et al. | 453/10 |
| 4,454,414 | A | 6/1984 | Benton | 235/379 |
| 4,474,197 | A | 10/1984 | Kinoshita et al. | 133/4 A |
| 4,488,116 | A | 12/1984 | Plesko | 324/236 |
| 4,531,531 | A | 7/1985 | Johnson et al. | 133/3 |
| 4,543,969 | A | 10/1985 | Rasmussen | 133/3 |
| 4,549,561 | A | 10/1985 | Johnson et al. | 133/3 |
| 4,556,140 | A | 12/1985 | Okada | 194/4 C |
| 4,558,711 | A | 12/1985 | Yoshiaki et al. | 133/3 F |
| 4,564,036 | A | 1/1986 | Ristvedt | 133/3 |
| 4,570,655 | A | 2/1986 | Raterman | 133/3 |
| 4,594,664 | A | 6/1986 | Hashimoto | 364/405 |
| 4,602,332 | A | 7/1986 | Hirose et al. | 364/408 |
| 4,607,649 | A | 8/1986 | Taipale et al. | 133/3 C |
| 4,620,559 | A | 11/1986 | Childers et al. | 133/3 R |
| 4,641,239 | A | 2/1987 | Takesako | 364/408 |
| 4,674,260 | A | 6/1987 | Rasmussen et al. | 53/212 |
| 4,681,128 | A | 7/1987 | Ristvedt et al. | 453/6 |
| 4,705,154 | A | 11/1987 | Masho et al. | 194/319 |
| 4,718,218 | A | 1/1988 | Ristvedt | 53/532 |
| 4,731,043 | A | 3/1988 | Ristvedt et al. | 453/6 |
| 4,733,765 | A | 3/1988 | Watanabe | 194/206 |
| 4,749,074 | A | 6/1988 | Ueki et al. | 194/317 |
| 4,753,624 | A | 6/1988 | Adams et al. | 453/10 |
| 4,753,625 | A | 6/1988 | Okada | 453/32 |
| 4,765,464 | A | 8/1988 | Ristvedt | 206/0.82 |
| 4,766,548 | A | 8/1988 | Cedrone et al. | 364/479 |
| 4,775,353 | A | 10/1988 | Childers et al. | 453/6 |
| 4,775,354 | A | 10/1988 | Rasmussen et al. | 453/10 |
| 4,778,983 | A | 10/1988 | Ushikubo | 235/381 |
| 4,803,347 | A | 2/1989 | Sugahara et al. | 235/379 |
| 4,804,830 | A | 2/1989 | Miyagisima et al. | 235/379 |
| 4,812,629 | A | 3/1989 | O'Neil et al. | 235/383 |
| 4,839,505 | A | 6/1989 | Bradt et al. | 235/381 |
| 4,840,290 | A | 6/1989 | Nakamura et al. | 221/10 |
| 4,844,369 | A | 7/1989 | Kanayachi | 242/56 R |
| 4,848,556 | A | 7/1989 | Shah et al. | 194/212 |
| 4,863,414 | A | 9/1989 | Ristvedt et al. | 453/6 |
| 4,883,158 | A | 11/1989 | Kobayashi et al. | 194/217 |
| 4,884,212 | A | 11/1989 | Stutsman | 364/479 |
| 4,900,909 | A | 2/1990 | Nagashima et al. | 235/487 |
| 4,908,516 | A | 3/1990 | West | 250/556 |
| 4,921,463 | A | 5/1990 | Primdahl et al. | 453/3 |
| 4,936,435 | A | 6/1990 | Griner | 194/317 |
| 4,953,086 | A | 8/1990 | Fukatsu | 364/408 |
| 4,954,697 | A | 9/1990 | Kokubun et al. | 235/381 |
| 4,964,495 | A | 10/1990 | Rasmussen | 194/344 |
| 4,966,570 | A | 10/1990 | Ristvedt et al. | 453/6 |
| 4,970,655 | A | 11/1990 | Winn et al. | 364/479 |
| 4,971,187 | A | 11/1990 | Furuya et al. | 194/318 |
| 4,988,849 | A | 1/1991 | Sasaki et al. | 235/379 |
| 4,992,647 | A | 2/1991 | Konishi et al. | 235/379 |
| 4,995,848 | A | 2/1991 | Goh | 453/3 |
| 5,009,627 | A | 4/1991 | Rasmussen | 453/10 |
| 5,010,238 | A | 4/1991 | Kadono et al. | 235/379 |
| 5,010,485 | A | 4/1991 | Bigari | 364/408 |
| 5,011,455 | A | 4/1991 | Rasmussen | 453/10 |
| 5,022,889 | A | 6/1991 | Ristvedt et al. | 453/6 |
| 5,025,139 | A | 6/1991 | Halliburton, Jr. | 235/379 |
| 5,026,320 | A | 6/1991 | Rasmussen | 453/6 |
| 5,031,098 | A | 7/1991 | Miller et al. | 364/405 |
| 5,033,602 | A | 7/1991 | Saarinen et al. | 194/334 |
| 5,039,848 | A | 8/1991 | Stoken | 235/381 |
| 5,055,086 | A | 10/1991 | Raterman et al. | 453/10 |
| 5,055,657 | A | 10/1991 | Miller et al. | 235/381 |
| 5,064,999 | A | 11/1991 | Okamoto et al. | 235/379 |
| 5,080,633 | A | 1/1992 | Ristvedt et al. | 435/6 |
| 5,091,713 | A | 2/1992 | Horne et al. | 340/541 |
| 5,104,353 | A | 4/1992 | Ristvedt et al. | 453/6 |
| 5,105,601 | A | 4/1992 | Horiguchi et al. | 53/465 |
| 5,106,338 | A | 4/1992 | Rasmussen et al. | 453/10 |
| 5,111,927 | A | 5/1992 | Schulze | 194/209 |
| 5,114,381 | A | 5/1992 | Ueda et al. | 453/57 |
| 5,120,945 | A | 6/1992 | Nishibe et al. | 235/379 |
| 5,123,873 | A | 6/1992 | Rasmussen | 453/10 |
| 5,129,205 | A | 7/1992 | Rasmussen | 53/52 |
| 5,135,435 | A | 8/1992 | Rasmussen | 453/56 |
| 5,140,517 | A | 8/1992 | Nagata et al. | 364/408 |
| 5,141,443 | A | 8/1992 | Rasmussen et al. | 453/10 |
| 5,141,472 | A | 8/1992 | Todd et al. | 453/10 |
| 5,145,455 | A | 9/1992 | Todd | 453/6 |
| 5,146,067 | A | 9/1992 | Sloan et al. | 235/381 |
| 5,154,272 | A | 10/1992 | Nishiumi et al. | 194/318 |
| 5,163,866 | A | 11/1992 | Rasmussen | 453/10 |
| 5,163,867 | A | 11/1992 | Rasmussen | 453/10 |
| 5,163,868 | A | 11/1992 | Adams et al. | 453/11 |
| 5,167,313 | A | 12/1992 | Dobbins et al. | 194/317 |
| 5,175,416 | A | 12/1992 | Mansvelt et al. | 235/379 |
| 5,176,565 | A | 1/1993 | Ristvedt et al. | 453/6 |
| 5,179,517 | A | 1/1993 | Sarbin et al. | 364/410 |
| 5,183,142 | A | 2/1993 | Latchinian et al. | 194/206 |
| 5,184,709 | A | 2/1993 | Nishiumi et al. | 194/318 |
| 5,194,037 | A | 3/1993 | Jones et al. | 453/10 |
| 5,197,919 | A | 3/1993 | Geib et al. | 453/10 |
| 5,205,780 | A | 4/1993 | Rasmussen | 453/10 |
| 5,207,784 | A | 5/1993 | Schwartzendruber | 221/6 |
| 5,209,696 | A | 5/1993 | Rasmussen et al. | 453/10 |
| 5,236,071 | A | 8/1993 | Lee | 194/200 |
| 5,243,174 | A | 9/1993 | Veeneman et al. | 235/381 |
| 5,251,738 | A | 10/1993 | Dabrowski | 194/206 |
| 5,252,811 | A | 10/1993 | Henochowicz et al. | 235/379 |
| 5,253,167 | A | 10/1993 | Yoshida et al. | 364/408 |
| 5,263,566 | A | 11/1993 | Nara et al. | 194/318 |
| 5,265,874 | A | 11/1993 | Dickinson et al. | 273/138 A |
| 5,268,561 | A | 12/1993 | Kimura et al. | 235/384 |
| 5,277,651 | A | 1/1994 | Rasmussen et al. | 453/10 |
| 5,282,127 | A | 1/1994 | Mii | 364/130 |
| 5,286,226 | A | 2/1994 | Rasmussen | 453/10 |
| 5,286,954 | A | 2/1994 | Sato et al. | 235/379 |
| 5,291,003 | A | 3/1994 | Avnet et al. | 235/381 |

(56) References Cited

U.S. PATENT DOCUMENTS

| | | | | |
|---|---|---|---|---|
| 5,291,560 | A | | 3/1994 | Daugman 382/2 |
| 5,293,981 | A | | 3/1994 | Abe et al. 194/345 |
| 5,297,030 | A | | 3/1994 | Vassigh et al. 364/405 |
| 5,297,598 | A | | 3/1994 | Rasmussen 141/314 |
| 5,297,986 | A | | 3/1994 | Ristvedt et al. 453/6 |
| 5,299,977 | A | | 4/1994 | Mazur et al. 453/10 |
| 5,324,922 | A | | 6/1994 | Roberts 235/375 |
| 5,326,104 | A | | 7/1994 | Pease et al. 273/138 A |
| 5,370,575 | A | | 12/1994 | Geib et al. 453/3 |
| 5,372,542 | A | | 12/1994 | Geib et al. 453/10 |
| 5,374,814 | A | | 12/1994 | Kako et al. 235/379 |
| 5,379,344 | A | | 1/1995 | Larson et al. 380/23 |
| 5,379,875 | A | | 1/1995 | Shames et al. 194/317 |
| 5,382,191 | A | | 1/1995 | Rasmussen 453/11 |
| 5,390,776 | A | | 2/1995 | Thompson 194/346 |
| 5,401,211 | A | | 3/1995 | Geib et al. 453/10 |
| 5,404,986 | A | | 4/1995 | Hossfield et al. 194/317 |
| 5,410,590 | A | | 4/1995 | Blood et al. 379/147 |
| RE34,934 | E | | 5/1995 | Raterman et al. 453/10 |
| 5,425,669 | A | | 6/1995 | Geib et al. 453/10 |
| 5,429,550 | A | | 7/1995 | Mazur et al. 453/10 |
| 5,440,108 | A | | 8/1995 | Tran et al. 235/381 |
| 5,450,938 | A | | 9/1995 | Rademacher 194/206 |
| 5,453,047 | A | | 9/1995 | Mazur et al. 453/10 |
| 5,468,182 | A | | 11/1995 | Geib 453/10 |
| 5,470,079 | A | | 11/1995 | LeStrange et al. 273/138 A |
| 5,474,495 | A | | 12/1995 | Geib et al. 453/3 |
| 5,474,497 | A | | 12/1995 | Jones et al. 453/17 |
| 5,480,348 | A | | 1/1996 | Mazur et al. 453/10 |
| 5,489,237 | A | | 2/1996 | Geib et al. 453/12 |
| 5,500,514 | A | | 3/1996 | Veeneman et al. 235/381 |
| 5,501,631 | A | | 3/1996 | Mennie et al. 453/3 |
| 5,507,379 | A | | 4/1996 | Mazur et al. 194/318 |
| 5,514,034 | A | | 5/1996 | Jones et al. 453/10 |
| 5,520,577 | A | | 5/1996 | Rasmussen 453/56 |
| 5,531,309 | A | | 7/1996 | Kloss et al. 194/202 |
| 5,538,468 | A | | 7/1996 | Ristvedt et al. 453/3 |
| 5,542,880 | A | | 8/1996 | Geib et al. 453/10 |
| 5,542,881 | A | | 8/1996 | Geib 453/10 |
| 5,553,320 | A | | 9/1996 | Matsuura et al. 235/379 |
| 5,559,887 | A | | 9/1996 | Davis et al. 380/24 |
| 5,564,546 | A | | 10/1996 | Molbak et al. 194/216 |
| 5,564,974 | A | | 10/1996 | Mazur et al. 453/10 |
| 5,564,978 | A | | 10/1996 | Jones et al. 453/17 |
| 5,570,465 | A | | 10/1996 | Tsakanikas 395/114 |
| 5,573,457 | A | | 11/1996 | Watts et al. 453/31 |
| 5,584,758 | A | | 12/1996 | Geib 453/10 |
| 5,592,377 | A | | 1/1997 | Lipkin 395/242 |
| 5,602,933 | A | | 2/1997 | Blackwell et al. 382/116 |
| 5,620,079 | A | * | 4/1997 | Molbak 194/217 |
| 5,623,547 | A | | 4/1997 | Jones et al. 380/24 |
| 5,625,562 | A | | 4/1997 | Veeneman et al. 364/479.05 |
| 5,630,494 | A | | 5/1997 | Strauts 194/317 |
| 5,641,050 | A | | 6/1997 | Smith et al. 194/210 |
| 5,650,605 | A | | 7/1997 | Morioka et al. 235/379 |
| 5,650,761 | A | | 7/1997 | Gomm et al. 235/381 |
| 5,652,421 | A | | 7/1997 | Veeneman et al. 235/381 |
| 5,665,952 | A | | 9/1997 | Ziarno 235/380 |
| 5,679,070 | A | | 10/1997 | Ishida et al. 453/41 |
| 5,684,597 | A | | 11/1997 | Hossfield et al. 356/384 |
| 5,696,366 | A | | 12/1997 | Ziarno 235/380 |
| 5,743,373 | A | | 4/1998 | Strauts 194/318 |
| 5,746,299 | A | | 5/1998 | Molbak et al. 194/200 |
| 5,774,874 | A | | 6/1998 | Veeneman et al. 705/27 |
| 5,782,686 | A | | 7/1998 | Geib et al. 453/10 |
| 5,799,767 | A | | 9/1998 | Molbak 194/217 |
| 5,813,510 | A | | 9/1998 | Rademacher 194/206 |
| 5,823,315 | A | | 10/1998 | Hoffman et al. 194/203 |
| 5,830,054 | A | | 11/1998 | Petri 453/5 |
| 5,838,812 | A | | 11/1998 | Pare, Jr. et al. 382/115 |
| 5,842,188 | A | | 11/1998 | Ramsey et al. 705/416 |
| 5,842,916 | A | | 12/1998 | Gerrity et al. 453/57 |
| 5,850,076 | A | | 12/1998 | Morioka et al. 235/379 |
| 5,854,581 | A | | 12/1998 | Mori et al. 235/379 |
| 5,865,673 | A | | 2/1999 | Geib et al. 453/10 |
| 5,880,444 | A | | 3/1999 | Shibata et al. 235/379 |
| 5,892,211 | A | | 4/1999 | Davis et al. 235/380 |
| 5,892,827 | A | | 4/1999 | Beach et al. 380/24 |
| 5,909,793 | A | | 6/1999 | Beach et al. 194/210 |
| 5,909,794 | A | | 6/1999 | Molbak et al. 194/216 |
| 5,913,399 | A | | 6/1999 | Takemoto et al. 194/200 |
| 5,918,748 | A | | 7/1999 | Clark et al. 209/534 |
| 5,940,623 | A | | 8/1999 | Watts et al. 395/712 |
| 5,944,162 | A | | 8/1999 | Filiberti 194/204 |
| 5,944,600 | A | | 8/1999 | Zimmermann 435/10 |
| 5,951,476 | A | | 9/1999 | Beach et al. 600/437 |
| 5,957,262 | A | | 9/1999 | Molbak et al. 194/200 |
| 5,988,348 | A | | 11/1999 | Martin et al. 194/317 |
| 5,995,949 | A | | 11/1999 | Morioka et al. 705/43 |
| 5,997,395 | A | | 12/1999 | Geib et al. 453/10 |
| 6,017,270 | A | | 1/2000 | Ristvedt et al. 453/5 |
| 6,021,883 | A | | 2/2000 | Casanova et al. 194/217 |
| 6,032,859 | A | | 3/2000 | Muehlberger et al. 235/449 |
| 6,039,644 | A | | 3/2000 | Geib et al. 453/10 |
| 6,039,645 | A | | 3/2000 | Mazur 453/10 |
| 6,042,470 | A | | 3/2000 | Geib et al. 453/10 |
| 6,047,807 | A | | 4/2000 | Molbak 194/217 |
| 6,047,808 | A | | 4/2000 | Neubarth et al. 194/317 |
| 6,056,104 | A | | 5/2000 | Neubarth et al. 194/317 |
| 6,080,056 | A | | 6/2000 | Karlsson 453/3 |
| 6,082,519 | A | | 7/2000 | Martin et al. 194/350 |
| 6,086,471 | A | | 7/2000 | Zimmermann 453/3 |
| 6,095,313 | A | | 8/2000 | Molbak et al. 194/344 |
| 6,116,402 | A | | 9/2000 | Beach et al. 194/216 |
| 6,131,625 | A | | 10/2000 | Casanova et al. 141/314 |
| 6,139,418 | A | | 10/2000 | Geib et al. 453/10 |
| 6,142,285 | A | | 11/2000 | Panzeri et al. 194/328 |
| 6,145,738 | A | | 11/2000 | Stinson et al. 235/379 |
| 6,154,879 | A | | 11/2000 | Pare, Jr. et al. 902/3 |
| 6,168,001 | B1 | | 1/2001 | Davis 194/200 |
| 6,171,182 | B1 | | 1/2001 | Geib et al. 453/10 |
| 6,174,230 | B1 | | 1/2001 | Gerrity et al. 453/57 |
| 6,196,371 | B1 | | 3/2001 | Martin et al. 194/317 |
| 6,196,913 | B1 | | 3/2001 | Geib et al. 453/10 |
| 6,213,277 | B1 | | 4/2001 | Blad et al. 194/350 |
| 6,230,928 | B1 | | 5/2001 | Hanna et al. 221/13 |
| 6,264,545 | B1 | | 7/2001 | Magee et al. 453/3 |
| 6,308,887 | B1 | | 10/2001 | Korman et al. 235/379 |
| 6,318,536 | B1 | | 11/2001 | Korman et al. 194/217 |
| 6,318,537 | B1 | | 11/2001 | Jones et al. 194/346 |
| 6,349,972 | B1 | | 2/2002 | Geiger et al. 283/67 |
| 6,412,620 | B1 | | 7/2002 | Imura 194/317 |
| 6,431,342 | B1 | | 8/2002 | Schwartz 194/346 |
| 6,438,230 | B1 | | 8/2002 | Moore 380/42 |
| 6,456,928 | B1 | | 9/2002 | Johnson 701/114 |
| 6,471,030 | B1 | | 10/2002 | Neubarth et al. 194/317 |
| 6,474,548 | B1 | | 11/2002 | Montross et al. 235/379 |
| 6,484,863 | B1 | | 11/2002 | Molbak 194/216 |
| 6,484,884 | B1 | | 11/2002 | Gerrity et al. 209/233 |
| 6,494,776 | B1 | | 12/2002 | Molbak 453/32 |
| 6,499,277 | B1 | | 12/2002 | Warner et al. 53/447 |
| 6,503,138 | B2 | | 1/2003 | Spoehr et al. 453/10 |
| 6,520,308 | B1 | | 2/2003 | Martin et al. 194/317 |
| 6,522,772 | B1 | | 2/2003 | Morrison et al. 382/124 |
| 6,547,131 | B1 | | 4/2003 | Foodman et al. 235/380 |
| 6,552,781 | B1 | | 4/2003 | Rompel et al. 256/71 |
| 6,554,185 | B1 | | 4/2003 | Montross et al. 235/379 |
| 6,579,165 | B2 | | 6/2003 | Kuhlin et al. 453/3 |
| 6,581,042 | B2 | | 6/2003 | Pare, Jr. et al. 705/40 |
| 6,602,125 | B2 | | 8/2003 | Martin 453/12 |
| 6,609,604 | B1 | | 8/2003 | Jones et al. 194/302 |
| 6,612,921 | B2 | | 9/2003 | Geib et al. 453/13 |
| 6,637,576 | B1 | | 10/2003 | Jones et al. 194/216 |
| 6,640,956 | B1 | | 11/2003 | Zwieg et al. 194/328 |
| 6,644,696 | B2 | | 11/2003 | Brown et al. 283/67 |
| 6,655,585 | B2 | | 12/2003 | Shinn 235/382 |
| 6,659,259 | B2 | | 12/2003 | Knox et al. 194/217 |
| 6,662,166 | B2 | | 12/2003 | Pare, Jr. et al. 705/39 |
| 6,663,675 | B2 | | 12/2003 | Blake et al. 753/63 |
| 6,666,318 | B2 | | 12/2003 | Gerrity et al. 194/347 |
| 6,755,730 | B2 | | 6/2004 | Geib et al. 453/3 |
| 6,758,316 | B2 | | 7/2004 | Molbak 194/200 |
| 6,761,308 | B1 | | 7/2004 | Hanna et al. 235/379 |
| 6,766,892 | B2 | | 7/2004 | Martin et al. 194/317 |

(56) References Cited

U.S. PATENT DOCUMENTS

| | | | | |
|---|---|---|---|---|
| 6,783,452 | B2 | 8/2004 | Hino et al. | 453/3 |
| 6,783,785 | B1 | 8/2004 | Raghavan et al. | 426/489 |
| 6,786,398 | B1 | 9/2004 | Stinson et al. | 235/379 |
| 6,854,581 | B2 | 2/2005 | Molbak | 194/344 |
| 6,854,640 | B2 | 2/2005 | Peklo | 235/100 |
| 6,863,168 | B1 | 3/2005 | Gerrity et al. | 194/347 |
| 6,892,871 | B2 | 5/2005 | Strauts et al. | 194/302 |
| 6,896,118 | B2 | 5/2005 | Jones et al. | 194/217 |
| 6,928,546 | B1 | 8/2005 | Nanavati et al. | 713/186 |
| 6,950,810 | B2 | 9/2005 | Lapsley et al. | 705/78 |
| 6,953,150 | B2 | 10/2005 | Shepley et al. | 235/379 |
| 6,957,746 | B2 | 10/2005 | Martin et al. | 221/131 |
| 6,966,417 | B2 | 11/2005 | Peklo et al. | 194/344 |
| 6,976,570 | B2 | 12/2005 | Molbak | 194/215 |
| 6,988,606 | B2 | 1/2006 | Geib et al. | 194/334 |
| 6,991,530 | B2 | 1/2006 | Hino et al. | 453/3 |
| 7,004,831 | B2 | 2/2006 | Hino et al. | 453/5 |
| 7,014,029 | B2 | 3/2006 | Winters | 194/302 |
| 7,014,108 | B2 | 3/2006 | Sorenson et al. | 235/381 |
| 7,017,729 | B2 | 3/2006 | Gerrity et al. | 194/347 |
| 7,018,286 | B2 | 3/2006 | Blake et al. | 453/61 |
| 7,028,827 | B1 | 4/2006 | Molbak et al. | 194/346 |
| 7,036,651 | B2 | 5/2006 | Tam et al. | 194/217 |
| 7,083,036 | B2 | 8/2006 | Adams | 194/223 |
| 7,113,929 | B1 | 9/2006 | Beach et al. | 705/65 |
| 7,131,580 | B2 | 11/2006 | Molbak | 235/379 |
| 7,149,336 | B2 | 12/2006 | Jones et al. | 382/135 |
| 7,152,727 | B2 | 12/2006 | Waechter | 194/317 |
| 7,158,662 | B2 | 1/2007 | Chiles | 382/135 |
| 7,188,720 | B2 | 3/2007 | Geib et al. | 194/302 |
| 7,213,697 | B2 | 5/2007 | Martin et al. | 194/317 |
| 7,243,773 | B2 | 7/2007 | Bochonok et al. | 194/350 |
| 7,269,279 | B2 | 9/2007 | Chiles | 382/135 |
| 7,303,119 | B2 | 12/2007 | Molbak | 235/379 |
| 7,331,521 | B2 | 2/2008 | Sorenson et al. | 235/381 |
| 7,337,890 | B2 | 3/2008 | Bochonok et al. | 194/353 |
| 7,427,230 | B2 | 9/2008 | Blake et al. | 453/63 |
| 7,438,172 | B2 | 10/2008 | Long et al. | 194/347 |
| 7,464,802 | B2 | 12/2008 | Gerrity et al. | 194/347 |
| 7,500,568 | B2 | 3/2009 | Cousin | 209/534 |
| 7,520,374 | B2 | 4/2009 | Martin et al. | 194/317 |
| 7,551,764 | B2 | 6/2009 | Chiles et al. | 382/135 |
| 7,552,810 | B2 | 6/2009 | Mecklenburg | 194/317 |
| 7,580,859 | B2 | 8/2009 | Economy et al. | 705/16 |
| 7,654,450 | B2 | 2/2010 | Mateen et al. | 235/379 |
| 7,658,270 | B2 | 2/2010 | Bochonok et al. | 194/350 |
| 7,735,125 | B1 | 6/2010 | Alvarez et al. | 726/9 |
| 7,743,902 | B2 | 6/2010 | Wendell et al. | 194/302 |
| 7,778,456 | B2 | 8/2010 | Jones et al. | 382/135 |
| 7,819,308 | B2 | 10/2010 | Osterberg et al. | 235/379 |
| 7,874,478 | B2 | 1/2011 | Molbak | 235/379 |
| 7,886,890 | B2 | 2/2011 | Blake et al. | 194/347 |
| 7,931,304 | B2 | 4/2011 | Brown et al. | 283/57 |
| 7,946,406 | B2 | 5/2011 | Blake et al. | 194/200 |
| 7,963,382 | B2 | 6/2011 | Wendell et al. | 194/302 |
| 7,980,378 | B2 | 7/2011 | Jones et al. | 194/217 |
| 8,023,715 | B2 | 9/2011 | Jones et al. | 382/135 |
| 8,042,732 | B2 | 10/2011 | Blake et al. | 235/375 |
| 8,229,821 | B2 | 7/2012 | Mennie et al. | 232/16 |
| 8,393,455 | B2 | 3/2013 | Blake et al. | 194/350 |
| 8,443,958 | B2 | 5/2013 | Jones et al. | 194/215 |
| RE44,252 | E | 6/2013 | Jones et al. | 194/217 |
| 8,523,641 | B2 | 9/2013 | Kuykendall et al. | 194/217 |
| 8,545,295 | B2 | 10/2013 | Blake et al. | 453/4 |
| 2001/0034203 | A1 | 10/2001 | Geib et al. | 453/3 |
| 2001/0048025 | A1 | 12/2001 | Shinn | 235/382 |
| 2002/0065033 | A1 | 5/2002 | Geib et al. | 453/3 |
| 2002/0069104 | A1 | 6/2002 | Beach et al. | 705/14 |
| 2002/0074209 | A1 | 6/2002 | Karlsson | 194/330 |
| 2002/0095587 | A1 | 7/2002 | Doyle et al. | 713/186 |
| 2002/0107738 | A1 | 8/2002 | Beach et al. | 705/14 |
| 2002/0126885 | A1 | 9/2002 | Mennie et al. | 382/135 |
| 2002/0130011 | A1 | 9/2002 | Casanova et al. | 194/344 |
| 2002/0147588 | A1 | 10/2002 | Davis et al. | 704/246 |
| 2002/0151267 | A1 | 10/2002 | Kuhlin et al. | 453/3 |
| 2002/0174348 | A1 | 11/2002 | Ting | 713/186 |
| 2002/0179401 | A1 | 12/2002 | Knox et al. | 194/217 |
| 2003/0004878 | A1 | 1/2003 | Akutsu et al. | 705/43 |
| 2003/0013403 | A1 | 1/2003 | Blake et al. | 453/60 |
| 2003/0042110 | A1 | 3/2003 | Wilfong | 194/302 |
| 2003/0081824 | A1 | 5/2003 | Mennie et al. | 382/135 |
| 2003/0127299 | A1 | 7/2003 | Jones et al. | 194/217 |
| 2003/0168309 | A1 | 9/2003 | Geib et al. | 194/302 |
| 2003/0168310 | A1 | 9/2003 | Strauts et al. | 194/302 |
| 2003/0182217 | A1 | 9/2003 | Chiles | 705/35 |
| 2003/0190882 | A1 | 10/2003 | Blake et al. | 453/63 |
| 2003/0234153 | A1 | 12/2003 | Blake et al. | 194/347 |
| 2004/0055902 | A1 | 3/2004 | Peklo | 206/0.815 |
| 2004/0092222 | A1 | 5/2004 | Kowalczyk et al. | 453/12 |
| 2004/0153406 | A1 | 8/2004 | Alarcon-Luther et al. | 705/41 |
| 2004/0153421 | A1 | 8/2004 | Robinson | 705/75 |
| 2004/0154899 | A1 | 8/2004 | Peklo et al. | 193/33 |
| 2004/0173432 | A1 | 9/2004 | Jones | 194/216 |
| 2004/0188221 | A1 | 9/2004 | Carter | 194/215 |
| 2004/0199924 | A1 | 10/2004 | Ganesh et al. | 719/313 |
| 2004/0200691 | A1 | 10/2004 | Geib et al. | 194/302 |
| 2004/0256197 | A1 | 12/2004 | Blake et al. | 194/350 |
| 2005/0006197 | A1 | 1/2005 | Wendell et al. | 194/302 |
| 2005/0035140 | A1 | 2/2005 | Carter | 221/195 |
| 2005/0040007 | A1 | 2/2005 | Geib et al. | 194/302 |
| 2005/0040225 | A1 | 2/2005 | Csulits et al. | 235/379 |
| 2005/0045450 | A1 | 3/2005 | Geib et al. | 194/318 |
| 2005/0067305 | A1 | 3/2005 | Bochonok et al. | 206/8 |
| 2005/0077142 | A1 | 4/2005 | Tam et al. | 194/217 |
| 2005/0087425 | A1 | 4/2005 | Peklo | 194/350 |
| 2005/0098625 | A1 | 5/2005 | Walker et al. | 235/381 |
| 2005/0108165 | A1 | 5/2005 | Jones et al. | 705/43 |
| 2005/0109836 | A1 | 5/2005 | Ben-Aissa | 235/380 |
| 2005/0121507 | A1 | 6/2005 | Brown et al. | 235/379 |
| 2005/0124407 | A1 | 6/2005 | Rowe | 463/25 |
| 2005/0156318 | A1 | 7/2005 | Douglas | 257/761 |
| 2005/0205654 | A1 | 9/2005 | Carter | 235/7 R |
| 2005/0205655 | A1 | 9/2005 | Carter | 235/7 R |
| 2005/0228717 | A1 | 10/2005 | Gusler et al. | 705/14 |
| 2005/0256792 | A1 | 11/2005 | Shimizu et al. | 705/35 |
| 2006/0037835 | A1 | 2/2006 | Doran et al. | 194/302 |
| 2006/0054455 | A1 | 3/2006 | Kuykendall et al. | 194/217 |
| 2006/0054457 | A1 | 3/2006 | Long et al. | 194/347 |
| 2006/0060363 | A2 | 3/2006 | Carter | 172/111 |
| 2006/0064379 | A1 | 3/2006 | Doran et al. | 705/42 |
| 2006/0065717 | A1 | 3/2006 | Hurwitz et al. | 235/381 |
| 2006/0069654 | A1 | 3/2006 | Beach et al. | 705/65 |
| 2006/0148394 | A1 | 7/2006 | Blake et al. | 453/12 |
| 2006/0149415 | A1 | 7/2006 | Richards | 700/236 |
| 2006/0151285 | A1 | 7/2006 | String | 194/350 |
| 2006/0154589 | A1 | 7/2006 | String | 453/11 |
| 2006/0175176 | A1 | 8/2006 | Blake | 194/216 |
| 2006/0182330 | A1 | 8/2006 | Chiles | 382/135 |
| 2006/0196754 | A1 | 9/2006 | Bochonok et al. | 194/347 |
| 2006/0205481 | A1 | 9/2006 | Dominelli | 463/25 |
| 2006/0207856 | A1 | 9/2006 | Dean et al. | 194/302 |
| 2006/0219519 | A1 | 10/2006 | Molbak et al. | 194/346 |
| 2006/0283685 | A1 | 12/2006 | Cousin | 194/217 |
| 2007/0051582 | A1 | 3/2007 | Bochonok et al. | 194/202 |
| 2007/0071302 | A1 | 3/2007 | Jones et al. | 382/135 |
| 2007/0108015 | A1 | 5/2007 | Bochonok et al. | 194/350 |
| 2007/0119681 | A1* | 5/2007 | Blake et al. | 194/215 |
| 2007/0181676 | A1 | 8/2007 | Mateen et al. | 235/381 |
| 2007/0187494 | A1 | 8/2007 | Hanna | 235/383 |
| 2007/0221470 | A1 | 9/2007 | Mennie et al. | 194/216 |
| 2007/0269097 | A1 | 11/2007 | Chiles et al. | 382/135 |
| 2008/0033829 | A1 | 2/2008 | Mennie et al. | 705/16 |
| 2008/0044077 | A1 | 2/2008 | Mennie et al. | 382/135 |
| 2008/0220707 | A1 | 9/2008 | Jones et al. | 453/2 |
| 2009/0018959 | A1 | 1/2009 | Doran et al. | 705/44 |
| 2009/0236200 | A1 | 9/2009 | Hallowell et al. | 194/215 |
| 2009/0236201 | A1 | 9/2009 | Blake et al. | 194/215 |
| 2009/0239459 | A1 | 9/2009 | Watts et al. | 453/18 |
| 2009/0242626 | A1 | 10/2009 | Jones et al. | 235/379 |
| 2009/0305620 | A1* | 12/2009 | Hino et al. | 453/5 |
| 2009/0320106 | A1 | 12/2009 | Jones et al. | 726/5 |
| 2010/0038419 | A1 | 2/2010 | Blake et al. | 235/379 |
| 2010/0198726 | A1 | 8/2010 | Doran et al. | 705/41 |
| 2010/0261421 | A1 | 10/2010 | Wendell et al. | 453/4 |

(56) References Cited

U.S. PATENT DOCUMENTS

| | | | | |
|---|---|---|---|---|
| 2010/0276485 | A1 | 11/2010 | Jones et al. | 235/379 |
| 2010/0327005 | A1 | 12/2010 | Martin et al. | 221/98 |
| 2011/0098845 | A1 | 4/2011 | Mennie et al. | 700/223 |
| 2011/0099105 | A1 | 4/2011 | Mennie et al. | 705/41 |
| 2011/0270695 | A1 | 11/2011 | Jones et al. | 705/43 |
| 2012/0067950 | A1 | 3/2012 | Blake | 235/381 |
| 2012/0156976 | A1 | 6/2012 | Blake et al. | 453/4 |
| 2013/0178139 | A1 | 7/2013 | Hallowell et al. | 453/15 |
| 2013/0199890 | A1 | 8/2013 | Blake | 194/216 |
| 2013/0205723 | A1 | 8/2013 | Blake et al. | 53/473 |

FOREIGN PATENT DOCUMENTS

| | | | | |
|---|---|---|---|---|
| CA | 2143943 | C | 3/2003 | G07D 3/16 |
| DE | 06 60 354 | | 5/1938 | G07F 17/26 |
| DE | 30 21 327 | A1 | 12/1981 | G07D 3/06 |
| EP | 0 351 217 | A2 | 1/1990 | G07F 9/04 |
| EP | 0 667 973 | B1 | 1/1997 | G07D 3/14 |
| EP | 0 926 634 | A2 | 6/1999 | G07D 3/14 |
| EP | 1 104 920 | A1 | 6/2001 | G07D 5/08 |
| EP | 1 209 639 | A2 | 5/2002 | G07F 19/00 |
| EP | 1 528 513 | A1 | 5/2005 | G07F 7/08 |
| FR | 2042254 | | 2/1971 | G07B 11/00 |
| GB | 2035642 | A | 6/1980 | G07F 7/10 |
| GB | 2175427 | A | 11/1986 | G07F 17/42 |
| GB | 2198274 | A | 6/1988 | G07D 3/00 |
| GB | 2458387 | A | 9/2009 | G07D 11/00 |
| GB | 2468783 | A | 9/2010 | C07D 9/00 |
| JP | 49-058899 | | 6/1974 | |
| JP | 52-014495 | | 2/1977 | G07F 5/10 |
| JP | 52-071300 | A | 6/1977 | G07F 5/22 |
| JP | 56-040992 | A | 4/1981 | G07F 5/18 |
| JP | 57-117080 | A | 7/1982 | G07D 3/16 |
| JP | 59-079392 | A | 5/1984 | G07D 3/16 |
| JP | 60-016271 | U | 2/1985 | G07F 7/02 |
| JP | 62-134168 | U | 8/1987 | G07B 1/00 |
| JP | 62-182995 | A | 8/1987 | G07F 7/08 |
| JP | 62-221773 | A | 9/1987 | G06F 15/30 |
| JP | 62-166562 | U | 10/1987 | G07B 1/00 |
| JP | 64-035683 | A | 2/1989 | G07D 9/00 |
| JP | 64-042789 | A | 2/1989 | G07F 9/00 |
| JP | 64-067698 | A | 3/1989 | G07F 7/08 |
| JP | 01-118995 | A | 5/1989 | G07G 1/00 |
| JP | 01-307891 | A | 12/1989 | G07D 9/00 |
| JP | 02-050793 | A | 2/1990 | G07D 9/00 |
| JP | 02-252096 | A | 10/1990 | G07D 9/00 |
| JP | 03-012776 | A | 1/1991 | G06F 15/30 |
| JP | 03-063795 | A | 3/1991 | G07D 3/00 |
| JP | 03-092994 | A | 4/1991 | G07D 9/00 |
| JP | 03-156673 | A | 7/1991 | G06F 15/30 |
| JP | 04-085695 | A | 3/1992 | G07F 11/72 |
| JP | 04-175993 | A | 6/1992 | G07F 5/22 |
| JP | 05-046839 | A | 2/1993 | G07D 5/02 |
| JP | 05-217048 | A | 8/1993 | G07D 3/16 |
| JP | 05-274527 | A | 10/1993 | G07D 9/00 |
| JP | 06-035946 | A | 2/1994 | G06F 15/30 |
| JP | 06-103285 | A | 4/1994 | G06F 15/21 |
| JP | 09-251566 | A | 9/1997 | G07F 7/08 |
| JP | 2002-117439 | A | 4/2002 | G07D 9/00 |
| JP | 2003-242287 | A | 8/2003 | G06F 17/60 |
| JP | 2004-213188 | A | 7/2004 | G06F 17/60 |
| SE | 44 244 | | 9/1988 | |
| WO | WO 85/00909 | A1 | 2/1985 | G07D 5/02 |
| WO | WO 91/06927 | A1 | 5/1991 | G07D 3/16 |
| WO | WO 91/08952 | A1 | 6/1991 | B65B 11/04 |
| WO | WO 91/12594 | A1 | 8/1991 | G07D 3/16 |
| WO | WO 91/18371 | A1 | 11/1991 | G07D 3/16 |
| WO | WO 92/08212 | A1 | 5/1992 | G07D 3/16 |
| WO | WO 92/20043 | A1 | 11/1992 | G07D 3/00 |
| WO | WO 92/20044 | A1 | 11/1992 | G07D 3/16 |
| WO | WO 92/22044 | A1 | 12/1992 | G07D 3/00 |
| WO | WO 93/00660 | A1 | 1/1993 | G07D 3/00 |
| WO | WO 93/09621 | A1 | 5/1993 | H04L 9/32 |
| WO | WO 94/06101 | A1 | 3/1994 | G07D 3/16 |
| WO | WO 94/08319 | A1 | 4/1994 | G07D 3/16 |
| WO | WO 94/23397 | A1 | 10/1994 | G07D 3/00 |
| WO | WO 95/02226 | A1 | 1/1995 | G07D 3/00 |
| WO | WO 95/04978 | A1 | 2/1995 | G07D 3/06 |
| WO | WO 95/06920 | A1 | 3/1995 | G07D 3/16 |
| WO | WO 95/09406 | A1 | 4/1995 | G07D 3/16 |
| WO | WO 95/13596 | A1 | 5/1995 | G07D 3/14 |
| WO | WO 95/19017 | A1 | 7/1995 | G07D 1/00 |
| WO | WO 95/23387 | A1 | 8/1995 | G07D 3/16 |
| WO | WO 95/30215 | A1 | 11/1995 | G07F 17/42 |
| WO | WO 96/07163 | A1 | 3/1996 | G07D 3/06 |
| WO | WO 96/07990 | A1 | 3/1996 | G07D 3/16 |
| WO | WO 96/12253 | A1 | 4/1996 | G07D 3/00 |
| WO | WO 96/27525 | A1 | 9/1996 | B65B 11/02 |
| WO | WO 96/27859 | A1 | 9/1996 | G07D 5/08 |
| WO | WO 97/22919 | A1 | 6/1997 | G06F 7/08 |
| WO | WO 97/25692 | A1 | 7/1997 | G07D 3/06 |
| WO | WO 98/24041 | A1 | 6/1998 | G06F 17/60 |
| WO | WO 98/24067 | A1 | 6/1998 | G07D 3/14 |
| WO | WO 98/48383 | A2 | 10/1998 | G07D 1/00 |
| WO | WO 98/48384 | A2 | 10/1998 | G07D 1/00 |
| WO | WO 98/48385 | A2 | 10/1998 | G07D 1/00 |
| WO | WO 98/51082 | A1 | 11/1998 | H04N 7/18 |
| WO | WO 98/59323 | A1 | 12/1998 | G07D 3/00 |
| WO | WO 99/00776 | A1 | 1/1999 | G07F 9/06 |
| WO | WO 99/06937 | A1 | 2/1999 | G06F 19/00 |
| WO | WO 99/16027 | A2 | 4/1999 | G07F 7/02 |
| WO | WO 99/33030 | A1 | 7/1999 | G07D 3/00 |
| WO | WO 99/41695 | A1 | 8/1999 | G06K 5/00 |
| WO | WO 99/48057 | A1 | 9/1999 | G07D 3/06 |
| WO | WO 99/48058 | A1 | 9/1999 | G07D 3/06 |
| WO | WO 00/48911 | A1 | 8/2000 | B65B 67/12 |
| WO | WO 00/65546 | A1 | 11/2000 | G07F 1/04 |
| WO | WO 01/63565 | A2 | 8/2001 | G07D 9/00 |
| WO | WO 02/071343 | A1 | 9/2002 | G07D 3/00 |
| WO | WO 03/052700 | A2 | 6/2003 | |
| WO | WO 03/079300 | A1 | 9/2003 | G07D 7/00 |
| WO | WO 03/085610 | A1 | 10/2003 | G07D 9/06 |
| WO | WO 03/107280 | A2 | 12/2003 | |
| WO | WO 2004/044853 | A1 | 5/2004 | G07D 3/12 |
| WO | WO 2004/109464 | A2 | 12/2004 | |
| WO | WO 2005/041134 | A2 | 5/2005 | |
| WO | WO 2005/088563 | A1 | 9/2005 | G07D 3/00 |
| WO | WO 2006/086531 | A1 | 8/2006 | G07D 9/00 |
| WO | WO 2007/035420 | A2 | 3/2007 | G06F 7/00 |
| WO | WO 2007/120825 | A2 | 10/2007 | G06K 9/00 |

OTHER PUBLICATIONS

AUI: Coinverter—"No More Lines . . . Self-Serve Cash-Out," by Cassius Elston, 1995 World Games Congress/Exposition Converter, 1 page (dated prior to 1995).

Brandt: 95 Series Coin Sorter Counter, 2 pages (1982).

Brandt: Model 817 Automated Coin and Currency Ordering System, 2 pages (1983).

Brandt: Model 920/925 Counter, 2 pages (date unknown, prior to Jul. 2011, possibly prior to Mar. 17, 1997).

Brandt: System 930 Electric Counter/Sorter, "Solving Problems, Pleasing Customer, Building Deposits," 1 page (date unknown, prior to Mar. 2, 2011, possibly prior to Mar. 17, 1997).

Brandt: Model 940-6 High Speed Sorter/Counter, 2 pages (date unknown, prior to Oct. 31, 1989).

Brandt: System 945 High-Speed Sorter, 2 pages (date unknown, prior to Mar. 2, 2011, possibly prior to Mar. 17, 1997).

Brandt: Model 952 Coin Sorter/Counter, 2 pages (date unknown, prior to Oct. 31, 1989).

Brandt: Model 954 Coin Sorter/Counter, 2 pages (date unknown, prior to Oct. 31, 1989).

Brandt: Model 957 Coin Sorter/Counter, 2 pages (date unknown, prior to Oct. 31, 1989).

Brandt: Model 958 Coin Sorter/Counter, 5 pages (© 1982).

Brandt: Model 960 High-Speed Coin Sorter & Counter, 2 pages (1984).

Brandt; Model 966 Microsort™ Coin Sorter and Counter, 4 pages, (1979).

Brandt: Model 970 Coin Sorter and Counter, 2 pages (1983).

Brandt: Model 1205 Coin Sorter Counter, 2 pages (1986).

(56) References Cited

OTHER PUBLICATIONS

Brandt: Model 1400 Coin Sorter Counter, 2 pages (date unknown, prior to Mar. 2, 2011, possibly prior to Mar. 17, 1997).
Brandt: Model 8904 Upfeed—"High Speed 4-Denomination Currency Dispenser," 2 pages (1989).
Brandt: Mach 7 High-Speed Coin Sorter/Counter, 2 pages (1992).
Case ICC Limited: CDS Automated Receipt Giving Cash Deposit System, 3 pages (date unknown, prior to Nov. 15, 2000).
Cash, Martin: Newspaper Article "Bank Blends New Technology With Service," Winnipeg Free Press, 1 page (Sep. 4, 1992).
Childers Corporation: Computerized Sorter/Counter, "To coin an old adage, time is money . . . ,"3 pages (1981).
CTcoin: CDS602 Cash Deposit System, 1 page (date unknown, prior to Jan. 15, 2001).
Cummins: Cash Information and Settlement Systems (Form 023-1408), 4 pages (date Dec. 1991).
Cummins: The Universal Solution to All Coin and Currency Processing Needs (Form 13C1218 3-83), 1 page (Mar. 1983).
Cummins: JetSort® High Speed Sorter/Counter Kits I & J—Operating Instructions (Form 022-7123-00) 12 pages (1994).
Cummins: JetSort® Coin Sorter Counter/CA-130XL Coin Wrapper, Cummins Automated Money Systems (AMS) Case Study—Fifth-Third, "6,000 Coin Per Minute Counter/Sorter Keeps pace With Fifth-Third Bank's Money Processing Needs," (Form 13C1180), 2 pages (Nov. 1981).
Cummins: JetSort®, "Venders Love JetSort," (13C1255), 1 page (Mar. 1987).
Cummins: JetSort® "High Speed Coin Sorter & Counter for Payphone Applications," "CTOCS Ready" (Form 023-1365), 2 pages (Mar. 1989).
Cummins: JetSort® mailer, "One moving part simplicity," "Vendors—Are validators changing your coin and currency needs?" (Form 023-1297), 3 pages (Apr. 1987).
Cummins: JetSort® Series V High Speed Coin Sorter/Counter, (Form 023-1383), 2 pages (Sep. 1990).
Cummins: JetSort® "Time for a Change, Be a smashing success!," (Form 023-1328), 1 page (Jun. 1988).
Cummins: JetSort® "Time for a Change—JetSort® vs. Brandt X," (Form 023-1330), 1 page (Jun. 1988).
Cummins: JetSort® "Time for a Change—No Coins Sorted After 3:00 or on Saturday," (Form 023-1327), 1 page (Aug. 1988).
Cummins: JetSort®, "What do all these Banks have in Common . . . ?", JetSort, CA-130XL coin wrapper, CA-118 coin wrapper, CA-4000 JetCount, (13C1203), 3 pages (Aug. 1982).
Cummins: JetSort® 700-01/CA-118 Coin Wrapper, Cummins Automated Money Systems (AMS) Case Study—University State Bank, "Cummins Money Processing System Boosts Teller Service at University State Bank," (Form 13C1192), 2 pages (Mar. 1982).
Cummins: JetSort® 700-01, Cummins Automated Money Systems (AMS) Case Study—First State Bank of Oregon, "JetSort® Gives Bank Coin Service Edge," (Form 13C1196), 2 pages (Apr. 1982).
Cummins: JetSort® 700-01 Coin Sorter/Counter, Operating Instructions, 14 pages (1982).
Cummins: JetSort® 701, Cummins Automated Money Systems (AMS) Case Study—Convenco Vending, "High Speed Coin Sorter increases coin processing power at Convenco Vending," (Form 13C1226), 2 pages (Jul. 1983).
Cummins: JetSort Models 701 and 750 , "State-of-the-art coin processing comes of age," 2 pages (Feb. 1984).
Cummins: JetSort® Model CA-750 Coin Processor (Item No. 50-152), 1 page (Jul. 1984).
Cummins: JetSort® Model CA-750 Coin Sorter/Counter and CA-4050 JetCount currency counter, "Money Processing Made Easy," (Form 13C1221) 2 pages (Jun. 1983).
Cummins: JetSort® Model 1701 with JetStops, Operating Instructions Manual (Form 022-1329-00), 16 pages (1984).
Cummins: JetSort® Model 1760 brochure, (Form 023-1262-00), 2 pages (Jul. 1985).
Cummins: JetSort® Models 1770 and 3000, Communication Package specification and operating instructions, 10 pages (uncertain, possibly Nov. 1985).
Cummins: JetSort® Model 1770, "JetSort® Speed and Accuracy, Now with Communications!", (Form 023-1272) 1 page (Oct. 1986).
Cummins: JetSort® 2000 Series High Speed Coin Sorter/Counter (Form 023-1488), 2 pages (Oct. 2000).
Cummins: JetSort® 3000 Series High Speed Coin Sorter (Form 023-1468 Rev 1), 2 pages (Feb. 1995).
Cummins: JetSort® 3000 Series Options, "Talking JetSort 3000," (Form 023-1338-00), 1 page (between Jan. 1989-Feb. 1989).
Cummins: JetSort® 3000, "3,000 Coins per Minute!," (Form 023-1312), 1 page (date unknown, est. 1987).
Cummins: JetSort® 3200, Enhanced electronics for the JetSort® 3200 (Form 023-1350), 1 page (Apr. 1987).
De La Rue: CDS 500 Cash Deponier System, 6 pages (date unknown, p. 5 has date May 1994, p. 6 has date Dec. 1992) (German).
De La Rue: CDS 5700 and CDS 5800 Cash Deponier System (German) and translation, 7 pages (date unknown, prior to Aug. 13, 1996).
Diebold: Merchant MicroBranch, "Merchant MicroBranch Combines ATM After-Hour Depository Rolled-Coin Dispenser," Bank Technology News, 1 page (Nov. 1997).
Fa. GBS-Geldbearbeitungssysteme: GBS9401SB Technical Specification, 24 pages (date unknown, prior to Nov. 10, 2010).
Frisco Bay: Commercial Kiosk, "Provide self-service solutions for your business customers," 4 pages (date unknown, prior to Mar. 2, 2011, p. 4 has date 1996).
Glory: AMT Automated Merchant Teller, 4 pages (date unknown, prior to Jan. 15, 2001).
Glory: CRS-8000 Cash Redemption System, 2 pages (1996).
Hamilton: Hamilton's Express Banking Center, in Less Space Than a Branch Manager's Desk, 4 pages (date unknown, prior to Jan. 15, 2001).
Intellectual Australia Pty. Ltd.: Microbank, "From down under: Microbank," "hand-held smart card terminal that combines smart card functions and telephone banking," 2 pages (Feb. 1996).
ISH Electronic: ISH I2005/500 Coin Counter (with translation), 4 pages (date unknown, prior to Aug. 1996).
ISH Electronic: ISH I2005/501 Self-Service Unit (with translation), 4 pages (date unknown, prior to Aug. 1996).
Namsys, Inc.: Namsys Express, Making currency management . . . more profitable, 2 pages (date unknown, prior to Jan. 15, 2001).
NGZ Geldzahlmaschinengesellschaft: NGZ 2100 Automated Coin Depository, 4 pages (date unknown, prior to Sep. 1996).
Perconta: Contomat Coin Settlement Machine for Customer Self Service, 2 pages (date unknown, prior to Apr. 2003).
Prema GmbH: Prema 405 (RE) Self Service Coin Deposit Facility, 2 pages (date unknown, prior to Apr. 2003).
Reis Eurosystems: CRS 6501/CRS 6510 Cash Receipt Systems for Self-Service Area, 3 pages (date unknown, prior to Aug. 13, 1996, maybe Feb. 1995).
Reis Eurosystems: CRS 6520/ CRS 6525 Standard-Class Coin Deposit Systems, 1 page (date unknown, prior to Apr. 2003).
Reis Eurosystems: CS 3510 Disc-Sorter, 1 page (date unknown, prior to Apr. 2003).
Royal Bank: Hemeon, Jade, "Royal's Burlington drive-in bank provides customers 24-hour tellers," The Toronto Star, 1 page (Aug. 21, 1991).
Royal Bank: Leitch, Carolyn, "High-Tech Bank Counts Coins," The Globe and Mail, 2 pages (Sep. 19, 1991).
Royal Bank: Oxby, Murray, "Royal Bank Opens 'Super Branch,'" The Gazette Montreal, 2 pages (Sep. 14, 1991).
Royal Bank: SuperBranch, "Experience the Ultimate in Convenience Banking," 2 pages (Feb. 1992).
Scan Coin: International Report, 49 pages (Apr. 1987).
Scan Coin: Money Processing Systems, 8 pages (date unknown, prior to Apr. 2003).
Scan Coin: World, 2 pages (Feb. 1988).
Scan Coin: CDS Cash Deposit System, 6 pages (date unknown, prior to Apr. 2003) [SC 0369].
Scan Coin: CDS Coin Deposit System—Technical Referens Manual, 47 pages (1989).

(56) References Cited

OTHER PUBLICATIONS

Scan Coin: CDS 600 User's Manual, 14 pages (date unknown, prior to Apr. 2003).
Scan Coin: CDS 600 & CDS 640 Cash Deposit System—Technical Manual, 45 pages (date unknown, prior to Apr. 2003).
Scan Coin: CDS MK 1 Coin Deposit System—Technical Manual, 32 pages (1991).
Scan Coin: SC 102 Value Counter Technical Manual, 28 pages (date unknown, prior to Apr. 2003).
Pay by Touch: Secure ID News, "Piggly Wiggly Extends Biometric Payments Throughout the Southeast U.S.," 2 pages, (Dec. 14, 2005).
ESD, Inc: Smartrac Card System, "Coinless laundry makes quarters obsolete; Smartrac Card System really makes a change in laundry industry," Business Wire, 2 pages (Feb. 23, 1996).
Meece, Mickey: Article "Development Bank of Singapore Gets Cobranding Edge with Smart Cards," American Banker, New York, NY, vol. 159, Iss. 195, p. 37, 2 pages (Oct. 10, 1994).

* cited by examiner

DISK-TYPE COIN PROCESSING UNIT WITH ANGLED SORTING HEAD

CLAIM OF PRIORITY AND CROSS-REFERENCE TO RELATED APPLICATION

This application claims the benefit of and priority to U.S. Provisional Patent Application No. 61/695,616, which was filed on Aug. 31, 2012, and is incorporated herein by reference in its entirety.

TECHNICAL FIELD

The present disclosure relates generally to systems, methods, and devices for processing currency. More particularly, the present disclosure relates to disk-type coin processing units and currency processing machines with disk-type coin processing units.

BACKGROUND

Many modern currency processing machines have the ability to receive bulk coins and/or bank notes from a user of the machine. The currency processing machine may be a redemption-type machine wherein, after the deposited coins and/or bank notes are counted, funds are returned to the user in a pre-selected manner, such as a payment ticket or voucher, a smartcard, a cash card, a gift card, and the like. Alternatively, the machine may be a deposit-type machine where funds which have been deposited by the user are credited to a personal account. Some currency processing machines are used in the financial, retail and gaming industries to sort, count, and package large volumes of currency for recirculation, transfer and/or distribution of the currency. Hybrid variations of these machines are also known and available.

In some currency processing machines, bulk coins may be deposited by users which are then sorted into individual denominations and subsequently fed into dedicated receptacles, each of which corresponds to a respective denomination of coin. When these receptacles have reached their storage capacity, an operator of the currency processing machine physically removes the full receptacle, and then replaces it with an empty receptacle so that the machine can be returned to its operational state. A disadvantage associated with these prior art currency processing machines is the time and labor required for an operator to unload the processed coins from the machine and subsequently return the machine to an operational state. Another associated disadvantage is that many of these prior art currency processing machines are unable to transact with a user while the operator is unloading the processed coins from the currency processing machine.

Various coin redemption machines are made accessible in banking environments and retail stores for public use. Because these coin redemption machines are placed in an area accessible by the general public, it is oftentimes necessary to take security precautions to deter theft and tampering. For example, the coin-containing receptacles (e.g., coin bags) of the redemption machine are typically stowed inside a secure housing. However, placing the coin receptacles within a secured housing can make it difficult and time consuming for an operator to access all of the coin receptacles. For example, due to packaging constraints, some coin bags need to be stowed inside the housing behind other coin bags—accessing the rearwardly disposed coin bags oftentimes takes additional time and effort. Thus, there exists a need for improved coin processing and management systems designed to mitigate the above-described problems.

SUMMARY

Currency processing systems, coin processing machines, disk-type coin processing units, and methods of sorting batches of coins are presented herein. For example, aspects of the present disclosure are directed to disk-type coin processing units and currency processing machines with disk-type coin processing units which utilize an angled sorting head to process the coins. Orienting the sorting head at a minimum angle off of horizontal allows the elevation of one or more of the coin exits of the sorting head to be increased without increasing the coin-in height of the coin processing unit. In addition, the entrance height and/or angle of one or more of the individual manifold chutes can be increased for configurations using a coin manifold to connect the coin exits of the sorting head with the coin receptacles.

Aspects of the present disclosure are directed to a currency processing system with a housing, one or more coin receptacles, and a disk-type coin processing unit. The housing, which is configured to rest on a support surface, includes a coin input area configured to receive a plurality of coins. The one or more coin receptacles are stowed inside the housing. The disk-type coin processing unit is operatively coupled to the coin input area and the one or more coin receptacles. The coin processing unit includes a rotatable disk that is configured to impart motion to the plurality of coins, and a sorting head having a lower surface generally parallel to and at least partially spaced from the rotatable disk. The lower surface forms a plurality of shaped regions configured to guide the coins, under the motion imparted by the rotatable disk, to a plurality of exit stations through which the coins are discharged to the one or more coin receptacles. The sorting head and the rotatable disk are obliquely angled with respect to the support surface upon which the housing rests.

A coin processing machine is also featured in accordance with aspects of this disclosure. The coin processing machine has a housing that is configured to rest on a support surface, and includes a coin input area that is configured to receive therethrough a batch of coins. A plurality of coin receptacles are stowed inside the housing. A disk-type coin processing unit, which is disposed at least partially inside the housing, is operatively coupled to the coin input area and the plurality of coin receptacles. The coin processing unit includes a rotatable disk that is configured to support on an upper surface thereof and impart motion to the coins received through the coin input area. The coin processing unit also includes a stationary sorting head having a lower surface generally parallel to and spaced slightly apart from the rotatable disk. The lower surface of the sorting head forms a plurality of exit channels configured to guide the coins, under the motion imparted by the rotatable disk, to a plurality of exit stations through which the coins are discharged to the plurality of coin receptacles. The upper surface of the rotatable disk and the lower surface of the stationary sorting head are obliquely angled with respect to the support surface upon which the housing rests.

According to other aspects of the present disclosure, a coin processing machine is presented for sorting batches of coins which include coins of mixed diameters. The coin processing machine includes a housing that is configured to rest on a planar horizontally oriented support surface. The housing includes a coin input area that is configured to receive coins therethrough. A coin tray, which is mounted to the housing, is configured to receive a batch of coins and feed the batch of coins into the housing through the coin input area. A plurality of coin bags is stowed side-by-side inside the housing in a generally linear fashion. Each coin bag is individually removable from the housing. The coin processing machine also includes a coin manifold with a plurality of chutes, each of which is configured to direct coins, under the force of gravity, into a respective one of the coin bags. A disk-type coin processing unit, which is stowed inside the housing, includes a rotatable disk, a motor, and a stationary sorting head. The rotatable disk includes a resilient top surface for supporting thereon coins received through the coin input area. The rotatable disk is configured to impart motion to the coins on the resilient top surface. The motor is configured to selectively rotate the rotatable disk. The stationary sorting head has a lower surface substantially parallel to and spaced slightly from the resilient top surface of the rotatable disk. The lower surface of the sorting head forms a plurality of individually shaped exit channels, each of the exit channels is configured to guide coins with a common diameter, under the motion imparted by the rotatable disk, to a respective one of a plurality of exit stations through which the coins are discharged to a respective one of the coin bags via a respective one of the chutes. The resilient top surface of the rotatable disk and the lower surface of the stationary sorting head are both obliquely angled at least approximately 10 degrees with respect to the support surface upon which the housing rests.

The above summary is not intended to represent each embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of the exemplary embodiments and modes for carrying out the present invention when taken in connection with the accompanying drawings and appended claims.

Figure 1:
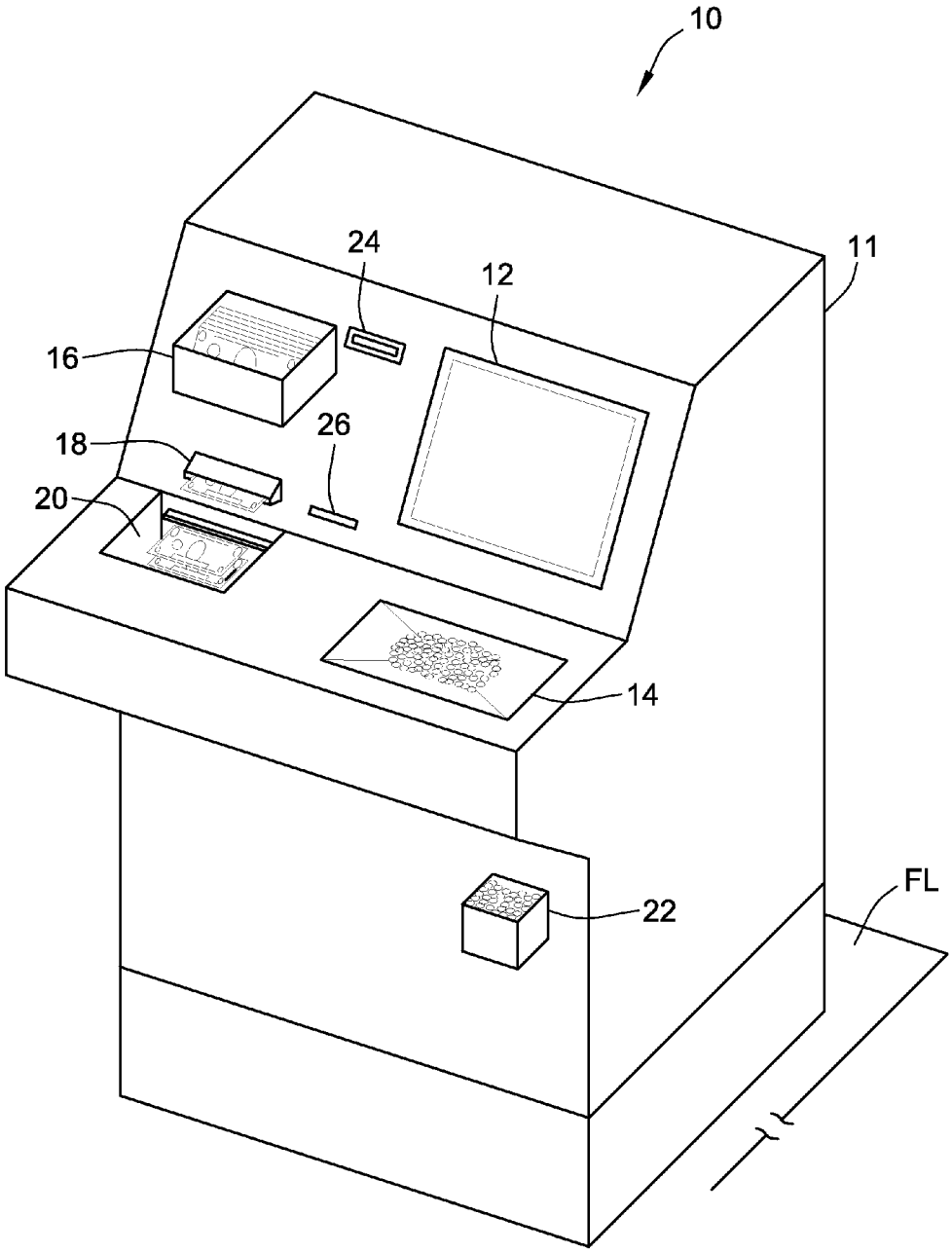
FIG. 1 is a front perspective-view illustration of a representative currency processing system in accordance with aspects of the present disclosure.

The present disclosure is susceptible to various modifications and alternative forms, and some representative embodiments have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of the invention as defined by the appended claims.

DETAILED DESCRIPTION OF THE ILLUSTRATED EMBODIMENTS

While this invention is susceptible of embodiment in many different forms, there are shown in the drawings, and will herein be described in detail, representative embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the word "including" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

Referring now to the drawings, wherein like reference numerals refer to like components throughout the several views, FIG. 1 illustrates an example of a currency processing system, designated generally as 10, in accordance with aspects of the present disclosure. Many of the disclosed concepts are discussed with reference to the representative currency processing systems depicted in the drawings. However, the novel aspects and features of the present disclosure are not per se limited to the particular arrangements and components presented in the drawings. For example, many of the features and aspects presented herein can be applied to other currency processing systems without departing from the intended scope and spirit of the present disclosure. In addition, although differing in appearance, the coin processing systems depicted and discussed herein can each take on any of the various forms, optional configurations, and functional alternatives described above and below with respect to the other disclosed embodiments, and thus can include any of the corresponding options and features. It should also be understood that the drawings are not necessarily to scale and are provided purely for descriptive purposes; thus, the individual and relative dimensions and orientations presented in the drawings are not to be considered limiting.

The currency processing system 10 is a hybrid redemption-type and deposit-type currency processing machine with which funds may be deposited into and returned from the machine, in similar or different forms, in whole or in part, and/or funds may be credited to and withdrawn from a personal account. The currency processing machine 10 illustrated in FIG. 1 includes a housing 11 that may house various input devices, output devices, and input/output devices. By way of non-limiting example, the currency processing machine 10 includes a display device 12 that may provide various input and output functions, such as displaying information and instructions to a user and receiving selections, requests, and other forms of inputs from a user. The display device 12 is, in various embodiments, a cathode ray tube (CRT), a high-resolution liquid crystal display (LCD), a plasma display, a light emitting diode (LED) display, a DLP projection display, an electroluminescent (EL) panel, or any other type of display suitable for use in the currency processing machine 10. A touch screen, which has one or more user-selectable soft touch keys, may be mounted over the display device 12. While a display device 12 with a touchscreen may be a preferred means for a user to enter data, the currency processing machine 10 may include other known input devices, such as a keyboard, mouse, joystick, microphone, etc.

The currency processing machine 10 includes a coin input area 14, such as a bin or tray, which receives batches of coins from a user. Each coin batch may be of a single denomination, a mixed denomination, a local currency, a foreign currency, and combinations thereof. Additionally, a bank note input area 16, which may be in the nature of a retractable pocket or basket, is also offered by the currency processing machine 10. The bank note input area 16, which is illustrated in its open position in FIG. 1, can be retracted by the currency processing machine 10 once the bulk currency has been placed therein by the user. In addition to banknotes, or as a possible alternative, the bank note receptacle 16 of the currency processing machine 10 can also be operable to accommodate casino scrip, paper tokens, bar coded tickets, or other known forms of value. These input devices—i.e., the currency input areas 14 and 16, allow the user of the currency processing machine 10 to input his or her funds, which can ultimately be converted to some other sort of fund source that is available to the user. Optionally, the currency processing machine 10 can operate to count, authenticate, valuate, and/or package funds deposited by a user.

In addition to the above-noted output devices, the currency processing machine 10 may include various output devices, such as a bank note dispensing receptacle 20 and a coin dispensing receptacle 22 for dispensing to the user a desired amount of funds in bank notes, coins, or a combination thereof. An optional bank note return slot 18 may also be included with the currency processing machine 10 to return notes to the user, such as those which are deemed to be counterfeit or otherwise cannot be authenticated or processed. Coins which cannot be authenticated or otherwise processed may be returned to the user via the coin dispensing receptacle 22. The currency processing machine 10 further includes a paper dispensing slot 26, which can be operable for providing a user with a receipt of the transaction that was performed.

In one representative transaction, the currency processing machine 10 receives funds from a user via the coin input area 14 and the bank note input area 16 and, after these deposited funds have been authenticated and counted, the currency processing machine 10 returns to the user an amount equal to the deposited funds but in a different variation of bank notes and coins. Optionally, the user may be assessed one or more fees for the transaction (e.g., service fees, transaction fees, etc.). For example, the user of the currency processing machine 10 may input $102.99 in various small bank notes and pennies and in turn receive a $100 bank note, two $1 bank notes, three quarters, two dimes, and four pennies. As another option or alternative, the currency processing machine 10 may simply output a voucher or a receipt of the transaction through the paper dispensing slot 26 which the user can then redeem for funds by an attendant of the currency processing machine 10. Yet another option or alternative would be for the currency processing machine 10 to credit some or all of the funds to a personal account, such as a bank account or store account. As yet another option, the currency processing machine 10 may credit some or all of the funds to a smartcard, gift card, cash card, etc.

The currency processing machine 10 may also include a media reader slot 24 into which the user inserts a portable medium or form of identification, such as a driver's license, credit card, or bank card, so that the currency processing machine 10 can, for example, identify the user and/or an account associated with the user. The media reader 24 may take on various forms, such as a ticket reader, card reader, bar code scanner, wireless transceiver (e.g., RFID, Bluetooth, etc.), or computer-readable-storage-medium interface. The display device 12 with a touchscreen typically provides the user with a menu of options which prompts the user to carry out a series of actions for identifying the user by displaying certain commands and requesting that the user press touch keys on the touch screen (e.g. a user PIN). The media reader device 24 of the illustrated example is configured to read from and write to one or more types of media. This media may include various types of memory storage technology such as magnetic storage, solid state memory devices, and optical devices. It should be understood that numerous other peripheral devices and other elements exist and are readily utilizable in any number of combinations to create various forms of a currency processing machine in accord with the present concepts.

Figure 2:
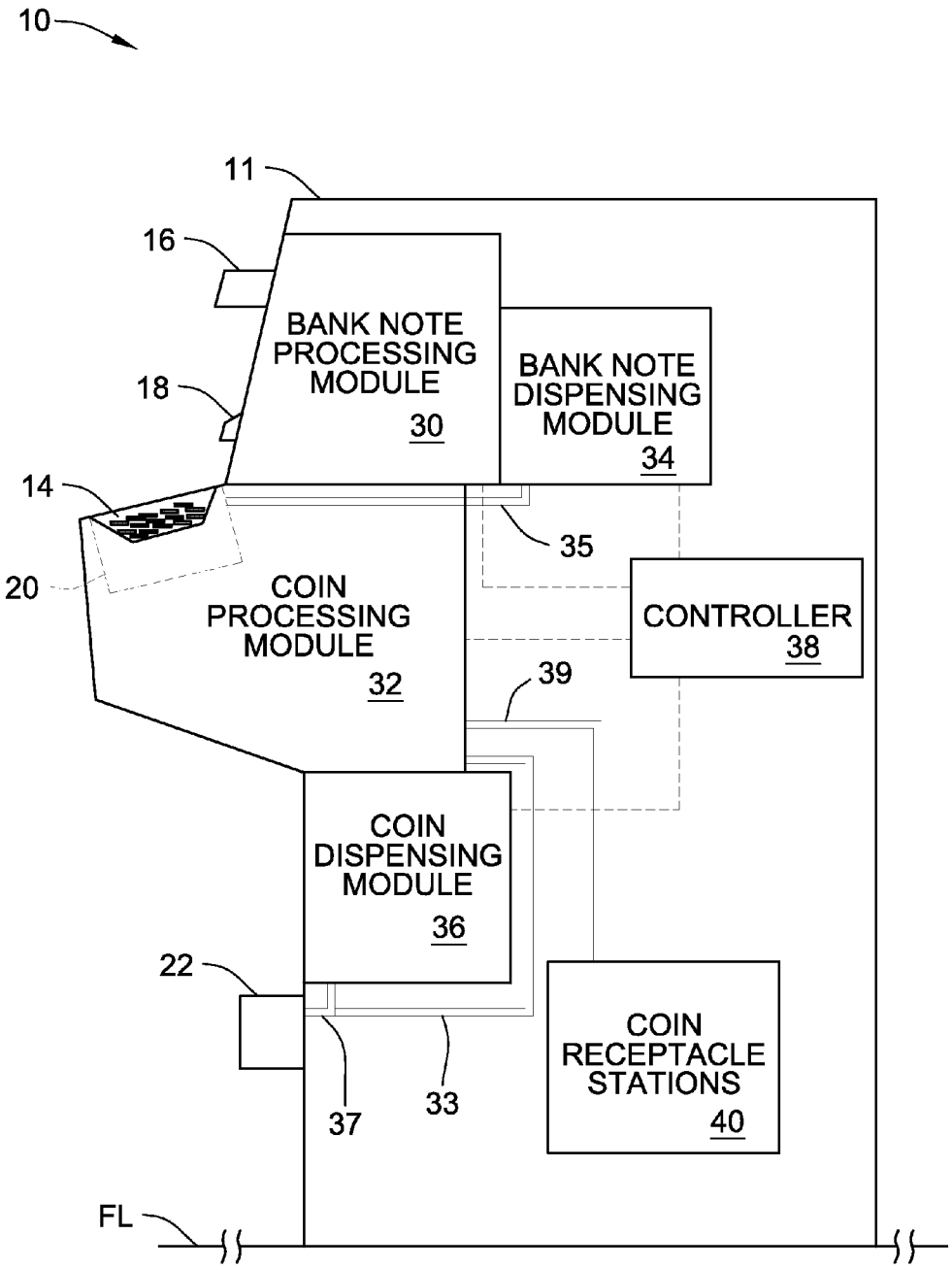
FIG. 2 is a schematic side-view illustration of the representative currency processing machine of FIG. 1.

FIG. 2 is a schematic illustration of the currency processing machine 10 showing various modules which may be provided in accord with the disclosed concepts. A bank note processing module 30, for example, receives bank notes from the bank note input area 16 for processing. In accord with a representative configuration, the inward movement of a retractable bank note input area 16 positions a stack of bills at a feed station of the bank note scanning and counting device which automatically feeds, counts, scans, authenticates, and/or sorts the bank notes, one at a time, at a high rate of speed (e.g., at least approximately 350 bills per minute). In place of, or in addition to the bank note input area 16, the currency processing machine 10 may include a single bank note receptacle for receiving and processing one bank note at a time. The bank notes that are recognized by the bank note processing module 30 are delivered to a currency canister, cassette or other known container. When a bank note cannot be recognized by the bank note processing module 30, it can be returned to the customer through the bank note return slot 18. Exemplary machines which scan, sort, count, and authenticate bills as may be required by the bank note processing module 30 are described in U.S. Pat. Nos. 5,295,196, 5,970,497, 5,875,259, which are incorporated herein by reference in their respective entireties and for all purposes.

The representative currency processing machine 10 shown in FIG. 2 also includes a coin processing module 32. The coin processing module 32 may be operable to sort, count, valuate and/or authenticate coins which are deposited in the coin input receptacle 14, which is operatively connected to the coin processing module 32. The coins can be sorted by the coin processing module 32 in a variety of ways, but one preferred method is sorting based on the diameters of the coins. When a coin cannot be authenticated or counted by the coin processing module 32, it can be directed back to the user through a coin reject tube 33 which leads to the coin dispensing receptacle 22. Thus, a user who has entered such a non-authenticated coin can retrieve the coin by accessing the coin dispensing receptacle 22. Exemplary coin sorting and authenticating devices which can perform the function of the coin processing module 32 are disclosed in U.S. Pat. Nos. 5,299, 977, 5,453,047, 5,507,379, 5,542,880, 5,865,673, 5,997,395, which are incorporated herein by reference in their respective entireties and for all purposes.

The currency processing machine 10 further includes a bank note dispensing module 34 which is connected via a transport mechanism 35 to the user-accessible bank note dispensing receptacle 20. The bank note dispensing module 34 typically dispenses loose bills in response to a request of the user for such bank notes. Also, the bank note dispensing module 34 may be configured to dispense strapped notes into the bank note dispensing receptacle 20 if that is desired. In one embodiment of the present disclosure, the user may select the denominations of the loose/strapped bills dispensed into the bank note dispensing receptacle 20.

The currency processing machine 10 also includes a coin dispensing module 36 which dispenses loose coins to the user via the coin dispensing receptacle 22. The coin dispensing module 36 is connected to the coin dispensing receptacle 22, for example, via a coin tube 37. With this configuration, a user of the currency processing machine 10 has the ability to select the desired coin denominations that he or she will receive during a transaction, for example, in response to user inputs received by one or more of the available input devices. Also, the coin dispensing module 36 may be configured to dispense packaged (e.g., sachet or rolled) coins into the coin dispensing receptacle 22 if that is desired. The coins which have been sorted into their respective denominations by the coin processing module 32 are discharged into one or more coin chutes or tubes 39 which direct coins to a coin receptacle station(s) 40. In at least some aspects, a plurality of tubes 39 are provided and advantageously are positioned to direct coins of specified denominations to designated coin receptacles. The currency processing machine 10 may include more or fewer than the modules illustrated in FIG. 2, such as a coin packaging module or a note packaging module.

The currency processing machine 10 includes a controller 38 which is coupled to each module within the currency processing machine 10, and optionally to an external system, and controls the interaction between each module. For example, the controller 38 may review the input totals from the funds processing modules 30 and 32 and direct an appropriate funds output via the funds dispensing modules 34 and 36. The controller 38 also directs the operation of the coin receptacle station 40 as described below. While not shown, the controller 38 is also coupled to the other peripheral components of the currency processing machine 10, such as a media reader associated with the media reader slot 24 and also to a printer at the receipt dispenser 26, if these devices are present on the coin processing mechanism 10. The controller 38 may be in the nature of a central processing unit (CPU) connected to a memory device. The controller 38 may include any suitable processor, processors and/or microprocessors, including master processors, slave processors, and secondary or parallel processors. The controller 38 may comprise any suitable combination of hardware, software, or firmware disposed inside or outside of the housing 11.

Figure 3:
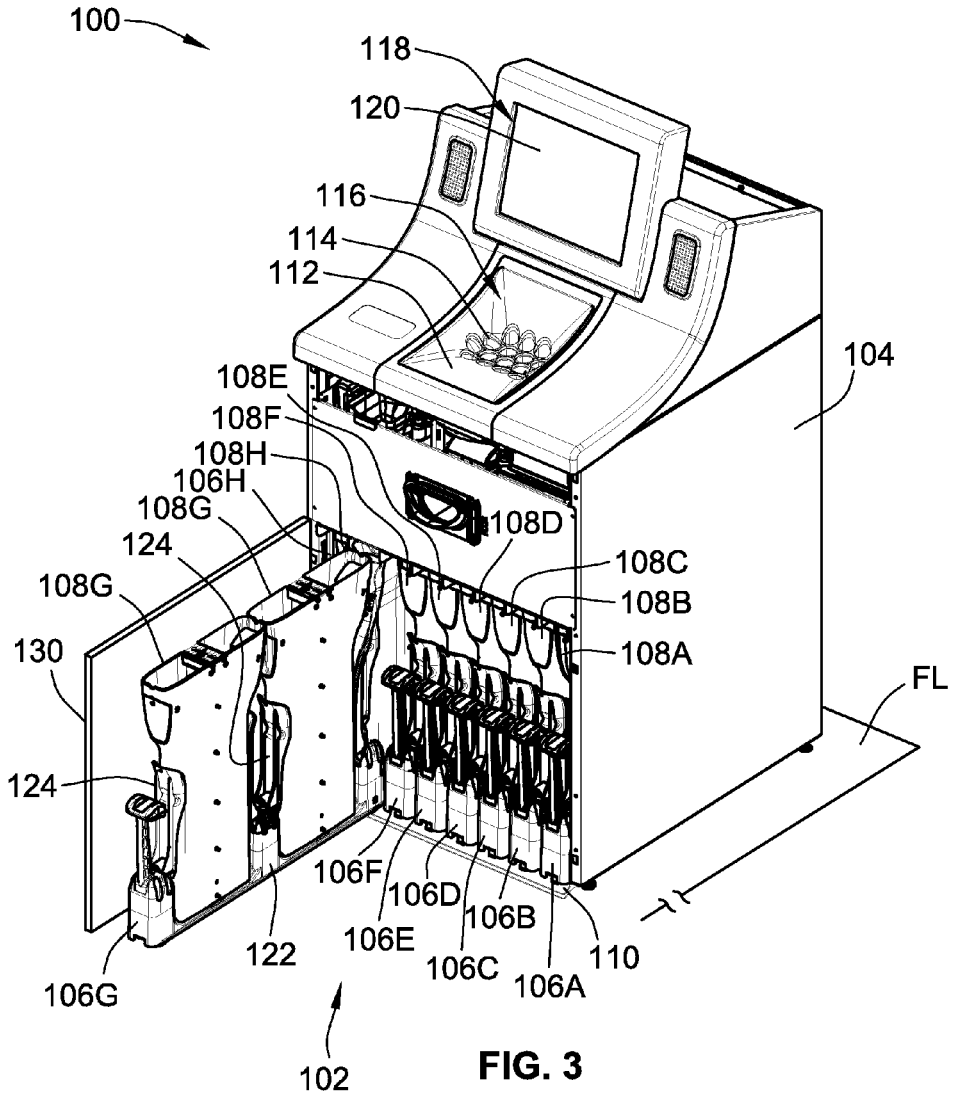
FIG. 3 is a front perspective-view illustration of a representative coin processing machine in accordance with aspects of the present disclosure.

Another example of a currency processing system is illustrated in accordance with aspects of this disclosure in FIG. 3, this time represented by a coin processing machine 100. The coin processing machine 100 has a coin tray 112 that holds coins prior to and/or during inputting some or all of the coins in the coin tray 112 into the coin processing machine 100. The coin tray 112 may be configured to transfer coins deposited thereon, e.g., by pivoting upwards and/or by downwardly sloping coin surfaces, to a con sorting mechanism (not visible in FIG. 3) disposed within a cabinet 104. The coins are transferred from the coin tray 112 to the sorting mechanism, under the force of gravity, via a funnel 114 formed in a coin input area 116 of the cabinet 104. Once processed, the coin sorting mechanism discharges sorted coins to a plurality of coin bags or other coin receptacles that are housed within the cabinet (or "housing") 104.

A user interface 118 interacts with a controller (e.g., controller 38 of FIG. 2) of the coin processing machine 100. The controller is operable, in at least some embodiments, to control the initiation and termination of coin processing, to determine the coin totals during sorting, to validate the coins, and to calculate or otherwise determine pertinent data regarding the sorted coins. The operator interface 118 of FIG. 3 includes a display device 120 for displaying information to an operator of the coin processing machine 100. Like the display device 12 illustrated in FIG. 1, the display device 120 of FIG. 3 may also be capable of receiving inputs from an operator of the coin processing machine 100, e.g., via a touchscreen interface. Inputs from an operator of the coin processing machine 100 can include selection of predefined modes of operation, instructions for defining modes of operation, requests for certain outputs to be displayed on the display device 120 and/or a printer (not shown), identification information, such as an identification code for identifying particular transactions or batches of coins, etc.

During an exemplary batch sorting operation, an operator dumps coins into the coin tray 112 and inputs an identification number along with any additional data via the interface 118. The operator (or the machine 100) then transfers the coins within the coin tray 112 to the sorting mechanism. While the coins are being sorted, the operator can deposit the next batch of coins into the coin tray 112 and enter data corresponding to the next batch.

The coin processing machine 100 has a coin receptacle station 102 disposed within the housing 104. When the coin processing machine 100 is disposed in a retail setting or other publicly accessible environment, e.g., for use as a retail coin redemption machine, the coin receptacle station 102 can be secured inside housing, e.g., via a locking mechanism, to prevent unauthorized access to the processed coins. The coin receptacle station 102 includes a plurality of moveable coin-receptacle platforms 106A-H ("moveable platforms"), each of which has one or more respective coin receptacles 108A-H disposed thereon. Each moveable platform 106A-H is slidably attached to a base 110, which may be disposed on the ground beneath the coin processing machine 100, may be mounted to the coin processing machine 100 inside the housing 104, or a combination thereof. In the illustrated embodiment, the coin receptacle station 102 includes eight moveable coin-receptacle platforms 106A-H, each of which supports two coin receptacles 108A-H, such that the coin processing machine 100 accommodates as many as sixteen individual receptacles. Recognizably, the coin processing machine 100 may accommodate greater or fewer than sixteen receptacles.

The coin receptacles 108A-H of the illustrated coin receptacle station 102 are designed to accommodate coin bags. Alternative variations may be designed to accommodate coin cassettes, cashboxes, coin bins, etc. Alternatively still, the moveable platforms 106A-H may have more than one type of receptacle disposed thereon. In normal operation, each of the coin receptacles 108A-H acts as a sleeve that is placed inside of a coin bag to keep coins within a designated volume during filling of the coin bag. In effect, the coin receptacle 108A-H acts as an internal armature, providing an otherwise non-rigid coin bag with a generally rigid internal geometry. Each of the platforms 106A-H includes a coin bag partition 122 that separates adjacent coin bags from one another for preventing coin bags from contacting adjacent coin bags and disrupting the flow of coins into the coin bags. For other embodiments, each moveable platform 106A-H may include multiple partitions 122 to accommodate three or more coin receptacles 108A-H. The moveable platforms 106A-H also include bag clamping mechanisms 124 for each of the coin receptacles 108A-H. Each bag clamping mechanism 124 operatively positions the coin bag for receiving processed coins, and provides structural support to the coin receptacle 108A-H when the moveable platform 106A-H is moved in and out of the machine.

The number of moveable platforms 106A-H incorporated into the coin processing machine 100 can correspond to the number of coin denominations to be processed. For example, in the U.S. coin set: pennies can be directed to the first coin receptacles 108A disposed on the first moveable platform 106A, nickels can be directed to the second coin receptacles 108B disposed on the second moveable platform 106B, dimes can be directed to the third coin receptacles 108C disposed on the third moveable platform 106C, quarters can be directed to the fourth coin receptacles 108D disposed on the fourth moveable platform 106D, half-dollar coins can be directed to the fifth coin receptacles 108E disposed on the fifth moveable platform 106E, dollar coins can be directed to the sixth coin receptacles 108F disposed on the sixth moveable platform 106F. The seventh and/or eighth moveable platforms 106G, 106H can be configured to receive coin overflow, invalid coins, or other rejected coins. Optionally, coins can be routed to the coin receptacles 108A-H in any of a variety of different manners. For example, in the illustrated configuration, if the operator of the coin processing machine 100 is anticipating a larger number of quarters than the other coin denominations, three or more of the coin receptacles 108A-H on the moveable platforms 106A-H may be dedicated to receiving quarters. Alternatively, half-dollar coins and dollar coins, of which there are fewer in circulation and regular use than the other coin denominations, can each be routed to a single dedicated coin receptacle.

In operation, an operator of the coin processing machine 100 who desires to access one or more of the coin receptacles 108A-H unlocks and opens a front door 130 of the housing 104 to access the coin receptacle station 102. Depending on which coin receptacle(s) the operator needs to empty, for example, the operator slides or otherwise moves one of the moveable coin-receptacle platforms 106A-H from a first "stowed" position inside the housing 104 (e.g., moveable platform 106A in FIG. 3) to a second "extracted" position outside of the housing 104 (e.g., moveable platform 106G in FIG. 3). If coin bags are used, for example, the operator may remove filled coin bags from the extracted movable platform, replace the filled coin bags with empty coin bags, return the movable platform to the stowed position, and subsequently shut and lock the front door 130.

Figure 4:
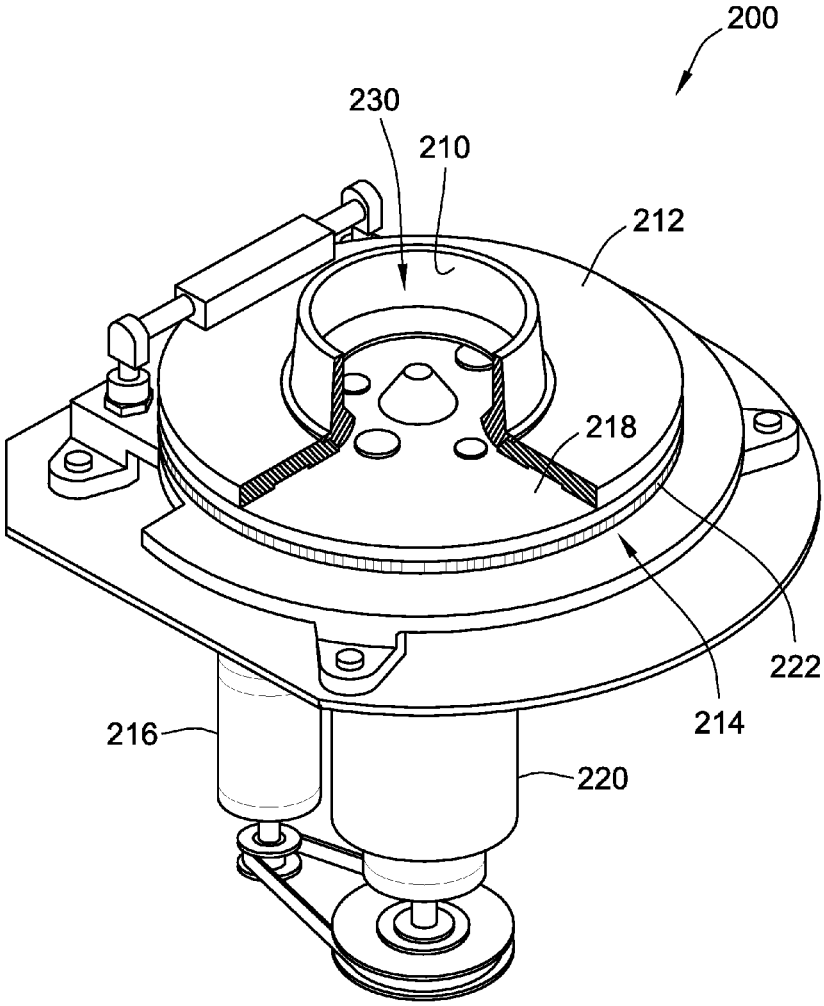
FIG. 4 is a partially broken away perspective-view illustration of a representative disk-type coin processing unit in accordance with aspects of the present disclosure.

FIG. 4 shows an example of a disk-type coin processing unit 200 that can be used in any of the currency processing systems disclosed herein. The coin processing unit 200 includes a hopper channel, a portion of which is shown at 210, for receiving coins of mixed denominations from a coin input area (e.g., coin input areas 14 or 116 of FIGS. 1 and 3). The hopper channel 210 feeds the coins through a central opening 230 in an annular, stationary sorting head 212. As the coins pass through this opening, the coins are deposited on the top surface of a resilient pad 218 disposed on a rotatable disk 214. According to some embodiments, coins are initially deposited by a user onto a coin tray (e.g., coin tray 112 of FIG. 3) disposed above the coin processing unit 200; coins flow from the coin tray into the hopper channel 210 under the force of gravity.

This rotatable disk 214 is mounted for rotation on a shaft (not shown) and driven by an electric motor 216. The rotation of the rotatable disk 214 of FIG. 4 is slowed and stopped by a braking mechanism 220. The disk 214 typically comprises a resilient pad 218, preferably made of a resilient rubber or polymeric material, that is bonded to, fastened on, or integrally formed with the top surface of a solid disk 222. The resilient pad 218 may be compressible such that coins laying on the top surface thereof are biased or otherwise pressed upwardly against the bottom surface of the sorting head 212 as the rotatable disk 214 rotates. The solid disk 222 is typically fabricated from metal, but it can also be made of other materials, such as a rigid polymeric material.

The underside of the inner periphery of the sorting head 212 is spaced above the pad 218 by a distance which is approximately the same as or, in some embodiments, just slightly less than the thickness of the thinnest coin. While the disk 214 rotates, coins deposited on the resilient pad 218 tend to slide outwardly over the top surface of the pad 218 due to centrifugal force. As the coins continue to move outwardly, those coins that are lying flat on the pad 218 enter the gap between the upper surface of the pad 218 and the lower surface of the sorting head 212. As is described in further detail below, the sorting head 212 includes a plurality of coin directing channels (also referred to herein as "shaped regions" or "exit channels") for manipulating the movement of the coins from an entry area to a plurality of exit stations where the coins are discharged from the coin processing unit 200. The coin directing channels may sort the coins into their respective denominations and discharge the coins from exit stations in the sorting head 212 corresponding to their denominations.

Figure 5:
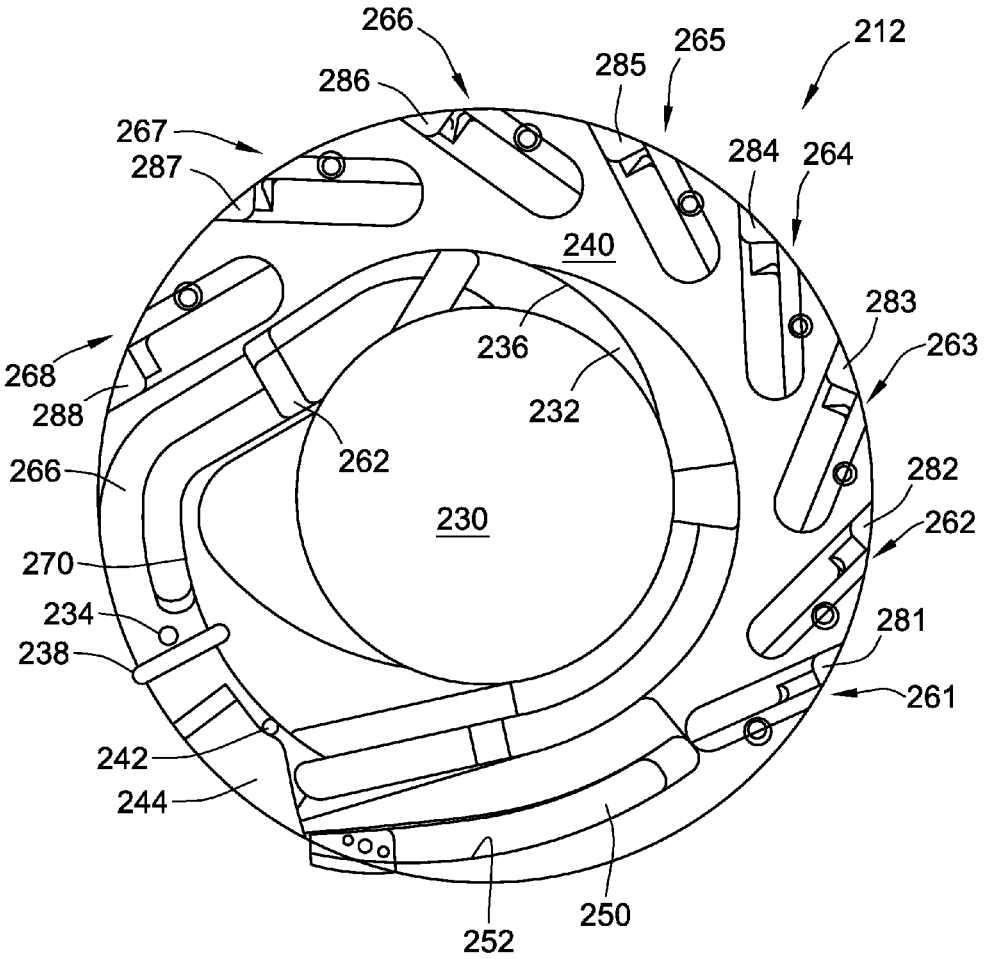
FIG. 5 is an enlarged bottom-view illustration of the sorting head of the exemplary disk-type coin processing unit of FIG. 4.

Referring now to FIG. 5, the underside of the sorting head 212 is shown. The coin set for a given country can be sorted by the sorting head 212 due to variations in the diameter of the individual coin denominations. For example, according to the United States Mint, the U.S. coin set has the following diameters:

Penny=0.750 in. (19.05 mm)
Nickel=0.835 in. (21.21 mm)
Dime=0.705 in. (17.91 mm)
Quarter=0.955 in. (24.26 mm)
Half Dollar=1.205 in. (30.61 mm)
Presidential One Dollar=1.043 in. (26.49 mm)

The coins circulate between the stationary sorting head 212 and the rotating pad 218 on the rotatable disk 214, as shown in FIG. 4. Coins that are deposited on the pad 218 via a central opening 230 initially enter an entry channel 232 formed in the underside of the sorting head 212. It should be kept in mind that the circulation of the coins in FIG. 5 appears counterclockwise as FIG. 5 is a view of the underside of the sorting head 212.

An outer wall 236 of the entry channel 232 divides the entry channel 232 from the lowermost surface 240 of the sorting head 212. The lowermost surface 240 is preferably spaced from the pad 218 by a distance that is slightly less than the thickness of the thinnest coins. Consequently, the initial outward radial movement of all the coins is terminated when the coins engage the outer wall 236, although the coins continue to move more circumferentially along the wall 236 (e.g., in a counterclockwise direction in FIG. 5) by the rotational movement imparted to the coins by the pad 218 of the rotatable disk 214.

While the pad 218 continues to rotate, those coins that were initially aligned along the wall 236 move across the ramp 262 leading to a queuing channel 266 for aligning the innermost edge of each coin along an inner queuing wall 270. The coins are gripped between the queuing channel 266 and the pad 218 as the coins are rotated through the queuing channel 266. The coins, which were initially aligned with the outer wall 236 of the entry channel 232 as the coins move across the ramp 262 and into the queuing channel 266, are rotated into engagement with inner queuing wall 270. As the pad 218 continues to rotate, the coins which are being positively driven by the pad move through the queuing channel 266 along the queuing wall 270 past a trigger sensor 234 and a discrimination sensor 238, which is operable for discriminating between valid and invalid coins. In some embodiments, the discrimination sensor 238 is also operable to determine the denomination of the coins. The trigger sensor 234 sends a signal to the discrimination sensor 238 that a coin is approaching.

In the illustrated example, coins determined to be invalid are rejected by a diverting pin 242 that is lowered into the coin path such that the pin 242 impacts the invalid coin and thereby redirects the invalid coin to a reject channel 244. The reject channel 244 guides the rejected coins to a reject chute that returns the coin to the user (e.g., rejected coins ejected into the coin reject tube 33 to the coin dispensing receptacle 22 of FIG. 1). The diverting pin 242 depicted in FIG. 5 remains in a retracted "nondiverting" position until an invalid coin is detected. Those coins not diverted into the reject channel 244 continue along inner queuing wall 270 to a gauging region 250. The inner queuing wall 270 terminates just downstream of the reject channel 244; thus, the coins no longer abut the inner queuing wall 270 at this point and the queuing channel 266 terminates. The radial position of the coins is maintained, because the coins remain under pad pressure, until the coins contact an outer wall 252 of the gauging region 250.

The gauging wall 252 aligns the coins along a common outer radius as the coins approach a series of coin exit channels 261-268 which discharge coins of different denominations through corresponding exit stations 281-288. The first exit channel 261 is dedicated to the smallest coin to be sorted (e.g., the dime in the U.S. coin set). Beyond the first exit channel 261, the sorting head 212 shown in FIGS. 4 and 5 forms seven more exit channels 262-268 which discharge coins of different denominations at different circumferential locations around the periphery of the sorting head 212. Thus, the exit channels 261-268 are spaced circumferentially around the outer periphery of the sorting head 212 with the innermost edges of successive channels located progressively closer to the center of the sorting head 212 so that coins are discharged in the order of increasing diameter. The number of exit channels can vary according to alternative embodiments of the present disclosure.

The innermost edges of the exit channels 261-268 are positioned so that the inner edge of a coin of only one particular denomination can enter each channel 261-268. The coins of all other denominations reaching a given exit channel extend inwardly beyond the innermost edge of that particular exit channel so that those coins cannot enter the channel and, therefore, continue on to the next exit channel under the circumferential movement imparted on them by the pad 218. To maintain a constant radial position of the coins, the pad 218 continues to exert pressure on the coins as they move between successive exit channels 261-268.

Further details of the operation of the sorting head 212 shown in FIGS. 4 and 5 are disclosed in U.S. Patent Application Publication No. US 2003/0168309 A1, which is incorporated herein by reference in its entirety. Other disk-type coin processing devices and related features that may be suitable for use with the coin processing devices disclosed herein are shown in U.S. Pat. Nos. 6,755,730; 6,637,576; 6,612,921; 6,039,644; 5,997,395; 5,865,673; 5,782,686; 5,743,373; 5,630,494; 5,538,468; 5,507,379; 5,489,237; 5,474,495; 5,429,550; 5,382,191; and 5,209,696, each of which is incorporated herein by reference in its entirety and for all purposes. In addition, U.S. Pat. Nos. 7,188,720 B2, 6,996,263 B2, 6,896,118 B2, 6,892,871 B2, 6,810,137 B2, 6,748,101 B1, 6,731,786 B2, 6,724,926 B2, 6,678,401 B2, 6,637,576 B1, 6,609,604, 6,603,872 B2, 6,579,165 B2, 6,318,537 B1, 6,171,182 B1, 6,068,194, 6,042,470, 6,039,645, 6,021,883, 5,982,918, 5,943,655, 5,905,810, 5,564,974, and 4,543,969, and U. S. Patent Application Publication Nos. 2007/0119681 A1 and 2004/0256197 A1, are incorporated herein by reference in their respective entireties and for all purposes.

Figure 6:
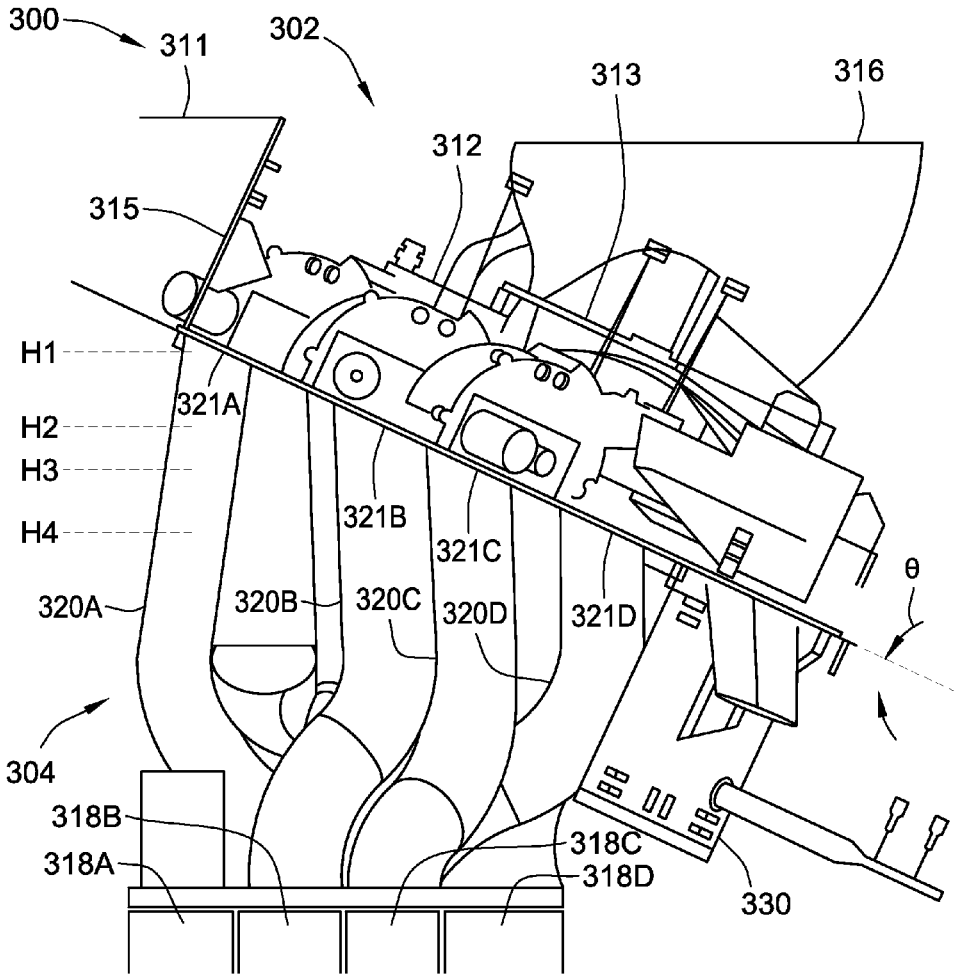
FIG. 6 is a side view illustration of a representative coin processing unit with an angled sorting head and a variable-entry-height coin manifold in accordance with aspects of the present disclosure.

FIG. 6 is a side-view illustration of a representative currency processing system 300 in accordance with aspects of the present disclosure. Although differing in appearance, the coin processing system 300, and its constituent components, can take on any of the various forms, optional configurations, and functional alternatives described above and below with respect to the other disclosed embodiments. The coin processing system 300, for example, includes a disk-type coin processing unit 302 for sorting batches of coins, including those with coins of mixed diameters, and a coin manifold 304 that directs coins from the coin processing unit 302, under the force of gravity, into one or more coin bags 318A-D. In this regard, the disk-type coin processing unit 302 may be structurally and functionally similar, if not identical, to the disk-type coin processing unit 200 of FIG. 4.

Like the currency processing systems 10 and 100 of FIGS. 1-3, the currency processing system 300 includes a housing 311 (only a minor portion of which is shown in FIG. 6) that may house various input devices, output devices, and input/output devices, including those detailed above. The housing 311 is configured to rest on a support surface, such as the planar, horizontally oriented floor surface FL of FIGS. 1-3. The housing 311 includes a coin input area 313 configured to receive therethrough a mixture of coins. In the illustrated embodiment, a coin hopper 316 is mounted to the housing 311. The coin hopper 316 of FIG. 6 receives coin batches fed, under the force of gravity, into the housing 311 through the coin input area 313. The coin processing unit 302 is mounted on an angled support plate 315 that is disposed inside the housing 311.

The coin processing system 300 also includes a number of coin receptacles 318A-D into which coins sorted by the coin processing unit 302 are discharged. By way of non-limiting example, there are four coin bags 318A-D stowed side-by-side inside the housing 311 in a generally linear fashion. Each coin bag 318A-D is individually removable from the housing 311. It is desirable, in at least some embodiments, that the coin bags 318A-D be arranged transversely along the front of the housing 311 in a manner similar to what is shown in FIG. 3. This arrangement helps to simplify removal and replacement of the individual coin bags 318A-D.

In the illustrated example, the elevation of the various coin receptacles—i.e., the coin bag heights—are the same. Alternative configurations will have coin receptacles of varying heights. The bag height of one or more or all of the coin bags 318A-D is at least approximately 29-31 inches. In accordance with at least some embodiments, the bag inlet height of at least one of the coin bags is at least approximately 30 inches and, in some embodiments, at least approximately 31 inches. Recognizably, the coin processing machine 300 may accommodate greater or fewer than four coin bags 318A-D without departing from the scope and spirit of the present disclosure.

The disk-type coin processing unit 302 is stowed, either partially or completely, inside the housing 311. Similar to the coin processing unit 200 of FIG. 4, the processing unit 302 of FIG. 6 has a rotatable disk (not visible in FIG. 6, but similar to the rotatable disk 214 of FIG. 4) with a resilient top surface for supporting coins received from the coin hopper 316 through the coin input area 313. A motor 330 selectively rotates the rotatable disk, whereby the rotatable disk imparts motion to the coins seated on the resilient top surface of the disk. A stationary sorting head 312 (similar to the sorting head 212 of FIGS. 4 and 5) has a lower surface that is substantially parallel to and spaced slightly apart from the resilient top surface of the rotatable disk. The lower surface of the sorting head forms a number of individually shaped exit channels, each of which guides coins with a common diameter, under the motion imparted by the rotatable disk, to a respective exit station through which the coins are discharged into one of the coin bags 318A-D via a respective one of the chutes 320A-D.

The upper surface of the rotatable disk and the lower surface of the stationary sorting head are obliquely angled with respect to the support surface upon which the housing 311 of the coin processing system 300 sits. By way of non-limiting example, the resilient top surface of the rotatable disk and the lower surface of the stationary sorting head form an angle θ of at least approximately 5 degrees and, in some embodiments, at least approximately 10 degrees with respect to the support surface upon which the housing 311 rests. In some embodiments, the sorting head and rotatable disk are obliquely angled at least approximately 15 degrees with respect to the support surface and, in some embodiments, at least approximately 20 degrees. Optionally, the rotatable disk and sorting head form an angle θ of at least approximately 10 degrees, but less than approximately 45 degrees, with respect to the support surface. Above certain angles, coins may begin to pool in the coin hopper. The coin processing unit 300 can include a mechanical guide, such as strategically placed guide fins and/or guide plates, which cooperate to reduce pooling of the coins in the coin hopper (e.g., via spreading out the coins on the surface of the rotatable disk or proximate the coin input area of the housing).

By orienting the sorting head and rotatable disk at a predetermined oblique angle off of horizontal, the elevations of one or more of the coin exits of the sorting head can be raised without raising the coin-in height of the coin processing unit. For configurations using a coin manifold to connect the coin exits of the sorting head with the coin receptacles, the entrance height and/or angle of one or more of the individual manifold chutes can be increased. In so doing, processed coins, especially those operating solely under the force of gravity, can travel further distances from the coin exits of the sorting head to the various locations of the individual coin receptacles. An advantage to this design is the ability to provide increased ergonomic access to the currency processing machine's coin receptacles—e.g., presentation of the receptacles to the user in a linear or substantially linear fashion at an ergonomically acceptable elevation off the floor. This, in turn, facilitates access to the individual coin receptacles and helps to reduce the time and labor required for an operator to unload processed coins from the currency processing machine and return the machine to an operational state. Another advantage is the ability to maintain an acceptable coin-in height (e.g., ergonomic coin tray elevation) and an acceptable coin-receptacle height (e.g., coin bag elevation) for currency processing machines with gravity-feed coin chutes. This, in turn, helps to minimize the overall height of the currency processing machine which, in turn, reduces storage, packaging and shipping costs. In addition, utilizing gravitational flow between the coin exits and coin receptacles eliminates the need to automate the coin feed, which reduces manufacturing and maintenance costs.

Gravity-feed coin manifold 304 guides coins discharged from the coin processing unit 302 into the coin bags 318A-D. The coin manifold 304 of FIG. 6 includes a plurality of elongated, tubular chutes—four of which are identified with reference numerals 320A-D. For some configurations, one manifold chute 320A-D is dedicated to each coin receptacle 318A-D secured inside the housing 311 of the currency processing system 300. Alternatively, each manifold chute 320A-D can be dedicated to a single coin-receptacle platform (e.g., platforms 106A-H of FIG. 3) and may be operable to direct coins, e.g., via a coin diverting mechanism, into any of the receptacles borne by that particular platform. In other configurations, one manifold chute may receive coins from a plurality of exit stations.

In at least some aspects of the disclosed concepts, each chute 320A-D receives coins from a respective one of the exit stations (e.g., exit stations 281-288 of FIG. 5) of the coin processing unit 302, and directs those coins, under the force of gravity, into a respective one or more of the coin bags 318A-D. In this regard, the chutes 320A-D have respective coin inlets 321A-D through which coins are received from their respective exit stations. Two or more or, in some embodiments, all of the coin inlets 321A-D have different respective inlet heights. By way of illustration, and not limitation, the first inlet height H1 of the first chute 320A of FIG. 6 is higher than the second inlet height H2 of the second chute 320B. The second inlet height H2 is higher than the third inlet height H3 of the third chute 320C, which is higher than the fourth inlet height H4 of the fourth chute 320D. With this configuration, the coin inlet heights of many or all of the individual manifold chutes can be increased without increasing the coin-in height of the coin processing unit. By increasing these inlet heights, processed coins operating under the force of gravity can travel farther to their corresponding coin receptacles. As such, some of the coin receptacles can be positioned at increased distances from the center of the coin processing unit. This, in turn, allows for greater freedom in packaging the coin receptacles in the currency processing system.

Figure 7:
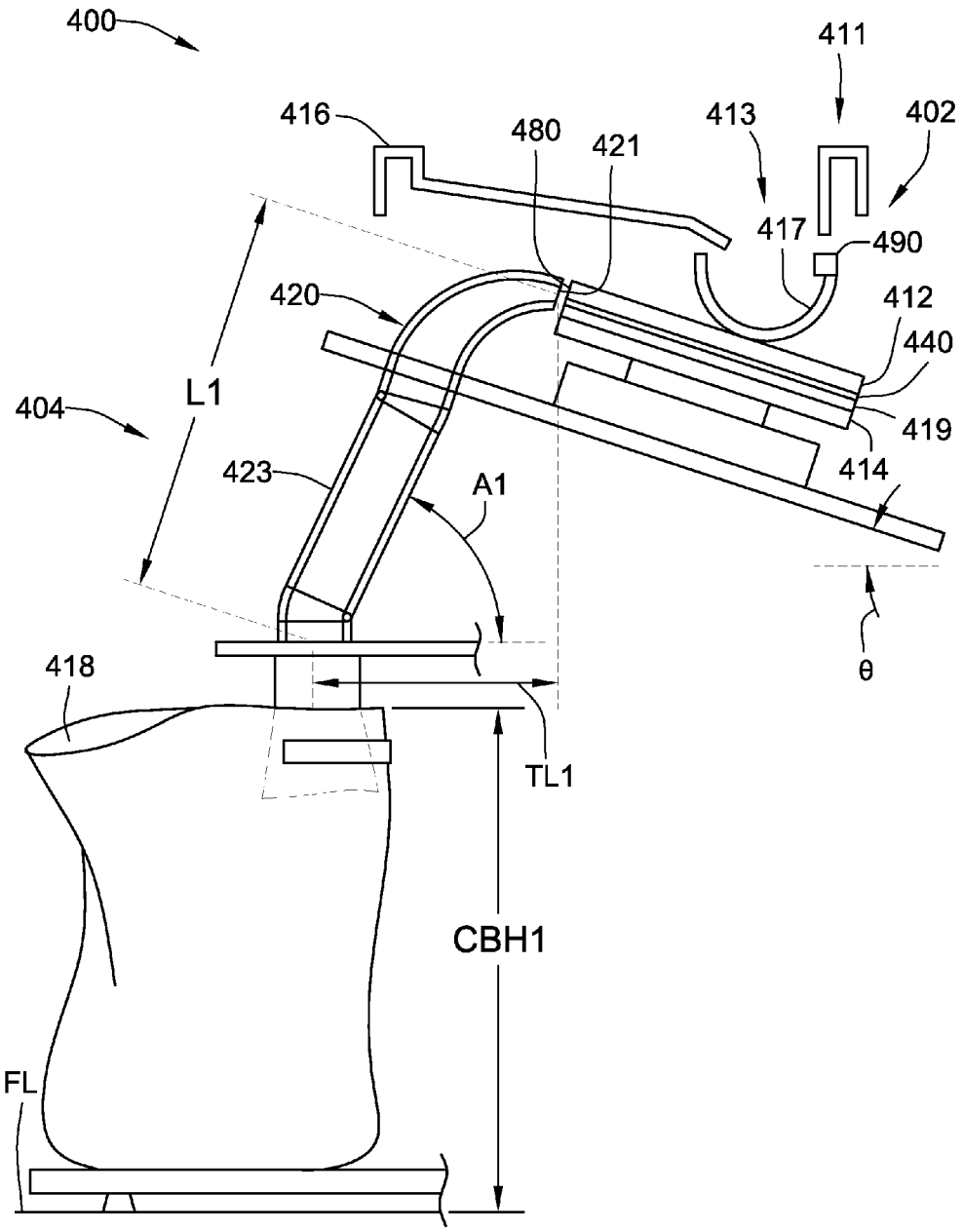
FIG. 7 is a schematic side-view illustration of a portion of another representative coin processing unit with an angled sorting head in accordance with aspects of the present disclosure.

With reference now to FIG. 7, wherein like reference numerals refer to like components from the other figures, there is shown a schematic illustration of another representative currency processing system, which is designated generally at 400. Although differing in appearance, the coin processing system 400, and its constituent components, can take on any of the various forms, optional configurations, and functional alternatives described above and below with respect to the other disclosed embodiments. For succinctness and brevity, description of these common components will be omitted.

The coin processing system 400 includes a disk-type coin processing unit 402 for sorting batches of coins, and a coin manifold 404 that directs coins from the coin processing unit 402 into one or more coin bags 418. Similar to the currency processing systems described above, the currency processing system 400 includes a housing (designated generally as 411) that houses various operational and peripheral devices. The housing 411, for example, includes a coin input area 413 configured to receive therethrough a mixture of coins. A gravity-feed coin tray 416, which is mounted to the top of the housing 411, receives coins from a user, and feeds the coins into a hopper 417 through the coin input area 413.

The disk-type coin processing unit 402 is stowed inside the housing 411. The processing unit 402 of FIG. 7 has a rotatable disk 414 with a resilient top surface 419 for supporting coins received through the coin input area 413. A stationary sorting head 412 has a lower surface 440 that is substantially parallel to and spaced slightly apart from the resilient top surface 419 of the rotatable disk 414. The lower surface 440 of the sorting head 412 forms a number of exit channels that guide coins, under motion imparted to the coins by the rotatable disk 414, to one or more exit stations 480 through which the coins are discharged into one of the coin bags 418 via a respective chute 420.

The representative coin processing unit 402 in FIG. 7 has a sorting head 412 and disk 414 mounted at an angle. In particular, the resilient top surface 419 of the rotatable disk 414 and the lower surface 440 of the sorting head 412 are mounted at an oblique angle with respect to the support surface FL upon which the housing 411 of the coin processing system 400 sits. For instance, the resilient top surface 419 and the lower surface 440 form an angle θ of approximately 10-45 degrees or, in some embodiments, 15-25 degrees with respect to the support surface FL upon which the housing 411 rests. Like the embodiments described above, the coin processing unit 402 can include a mechanical guide 490 to spread out the coins in the hopper and reduce unwanted pooling of coins in the hopper.

The coin manifold 404 of FIG. 7 includes a plurality of elongated, tubular chutes, only one of which is shown in FIG. 7 at 420. The chute 420 has an elongated tubular body 423 with a coin inlet 421 through which coins are received from the exit station 480 of the coin processing unit 402. The chute 420 has an overall length L1, a throw length TL1 (e.g., the horizontal distance between the corresponding coin exit and bag inlet) and a throw angle A1 . By angling the coin processing unit 402 in the manner described above, two or more of the chutes 420 can have different overall lengths, throw angles and/or throw lengths. In the embodiment of FIG. 7, the tubular body 423 of the chute 420 has a large throw angle A1, for example, that is greater than 45 degrees. The tubular body 423 also has a long overall length L1 (e.g., sufficiently long to accommodate coin bags with a reduced coin bag elevation, for example, a coin bag height CBH1 of less than 29 inches) and a long throw length TL1 (e.g., sufficiently long to direct coins to the distal-most coin bag at the end of a rectilinear line of coin bags). In at least some embodiments, all of the coin chutes 420 have a throw angle of at least approximately 20 degrees and, in some embodiments, at least approximately 22 degrees.

Another advantage of the above configuration is the ability to increase the coin exit height(s) of the coin processing unit 402, while maintaining an acceptable coin-in height and a desired minimum overall envelope of the currency processing system 400. In some embodiments, the footprint of the currency processing system 400 is approximately 450 to 550 square inches. In some embodiments, the footprint of the currency processing system 400 is approximately 500 square inches. In some embodiments, the housing 411 of currency processing system 400 has a 24 inch width and a 21 inch depth. A height of the coin hopper is, in at least some embodiments, approximately 36 to 42 inches and, in other embodiments, 39 inches.

Figure 8:
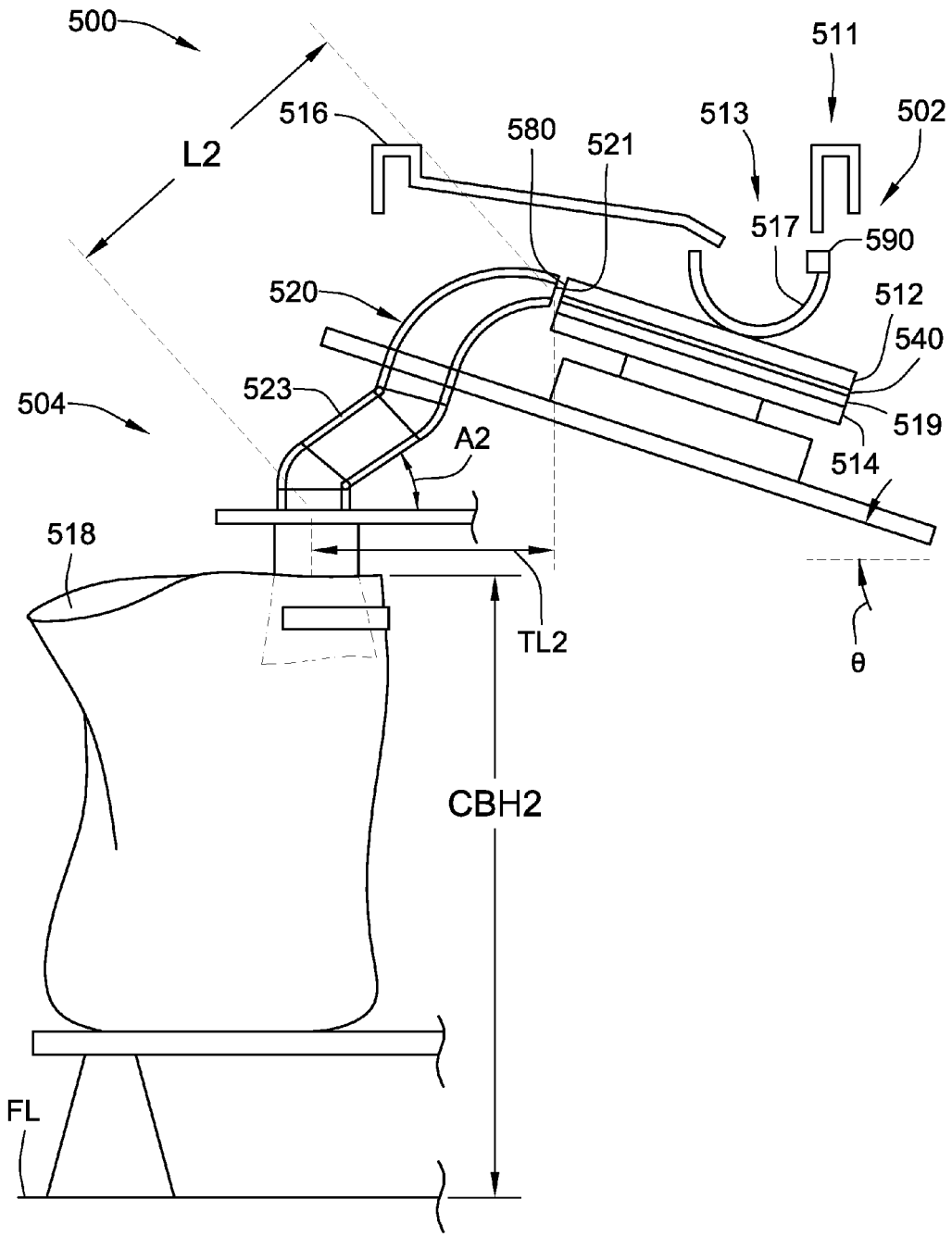
FIG. 8 is a schematic side-view illustration of a portion of yet another representative coin processing unit with an angled sorting head in accordance with aspects of the present disclosure.

Shown in FIG. 8, wherein like reference numerals refer to like components from the other views, is a schematic illustration of yet another representative currency processing system 500. The coin processing system 500 of FIG. 8, as well as its constituent components, can take on any of the various forms, optional configurations, and functional alternatives described above and below with respect to the other disclosed embodiments. For succinctness and brevity, description of these common components will not be repeated.

The coin processing system 500 includes a disk-type coin processing unit 502 for sorting batches of coins, and a coin manifold 504 that directs coins from the coin processing unit 502 into one or more coin bags 518. The currency processing system 500 includes a housing 511 with a coin input area 513 and a coin tray 516 that receives coins from a user, and feeds the coins into a hopper 517 inside the housing 511 through the coin input area 513. The coin processing unit 502 of FIG. 8 has a rotatable disk 514 with a resilient top surface 518, and a stationary sorting head 512 with a lower surface 540 that is substantially parallel to and spaced slightly apart from the top surface 518 of the rotatable disk 514. The resilient upper surface 518 of the rotatable disk 514 and the lower surface 540 of the sorting head 512 are both mounted at an oblique angle with respect to the support surface FL upon which the housing 511 of the coin processing system 500 sits.

The coin manifold 504 of FIG. 8 includes a plurality of elongated, tubular chutes, only one of which is shown in the drawings at 520. The chute 520 has an elongated tubular body 523 with a coin inlet 521 through which coins are received from the exit station 580 of the coin processing unit 502. The chute 520 has an overall length L2, a throw length TL2 (e.g., the horizontal distance between the corresponding coin exit and bag inlet) and a throw angle A2. In the embodiment of FIG. 8, the tubular body 523 of the chute 520 has a relatively small throw angle A2, for example, that is less than 30 degrees. The tubular body 523 also has a relatively short overall length L2 (e.g., to accommodate coin bags with an increased coin bag elevation, for example, a coin bag height CBH2 of at least approximately 31 inches) and a short throw length TL2 (e.g., to direct coins to the more proximal coin bags in a line of coin bags).

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. A currency processing system comprising:

a housing configured to rest on a support surface, the housing including a coin input area configured to receive a plurality of coins;

one or more coin receptacles; and a disk-type coin processing unit operatively coupled to the coin input area and the one or more coin receptacles, the coin processing unit including:

a singular rotatable disk configured to support thereon coins received from the coin input area of the housing and impart motion to the coins, and a singular sorting head having a central opening, through which the coins are received from the coin input area, and a lower surface, which is generally parallel to and at least partially spaced from the rotatable disk, the lower surface forming a plurality of shaped regions configured to guide the coins, under the motion imparted by the rotatable disk, to a plurality of exit stations through which the coins are discharged to the one or more coin receptacles, wherein the sorting head and the rotatable disk, including the central opening for receiving coins, are obliquely angled with respect to the support surface upon which the housing rests.

2. The currency processing system of claim 1, wherein the lower surface of the sorting head, which guides the coins to the exit stations, and an upper surface of the rotatable disk, which supports thereon the coins received from the coin input area of the housing, are obliquely angled with respect to the support surface.

3. The currency processing system of claim 1, further comprising an angled hopper configured to receive the coins directly from the coin input area of the housing and feed the coins directly into the singular rotatable disk and the singular sorting head.

4. The currency processing system of claim 1, wherein the sorting head and the rotatable disk are obliquely angled at least approximately 20 degrees with respect to the support surface.

5. The currency processing system of claim 1, wherein the sorting head is obliquely angled at least approximately 10 degrees, but less than approximately 45 degrees, with respect to the support surface.

6. The currency processing system of claim 1, wherein the one or more coin receptacles includes a plurality of coin receptacles, the currency processing system further comprising a coin manifold with a plurality of chutes, each of the chutes being configured to receive coins from a respective one of the exit stations and direct coins, under the force of gravity, into a respective one of the coin receptacles.

7. The currency processing system of claim 6, wherein two or more of the chutes have different respective inlet heights.

8. The currency processing system of claim 6, wherein two or more of the chutes have different respective throw angles with respect to the support surface upon which the housing rests.

9. The currency processing system of claim 6, wherein the plurality of chutes each has a respective throw angle of at least approximately 20 degrees with respect to the support surface upon which the housing rests.

10. The currency processing system of claim 1, further comprising a hopper operatively coupled to the coin input area of the housing, and a mechanical guide configured to reduce pooling of the coins in the hopper.

11. The currency processing system of claim 1, wherein the footprint of the currency processing system is approximately 450 to 550 square inches.

12. The currency processing system of claim 1, wherein the footprint of the currency processing system is approximately 500 square inches.

13. The currency processing system of claim 1, wherein the one or more coin receptacles includes a plurality of coin receptacles, the plurality of coin receptacles being stowed inside the housing in a generally linear fashion.

14. The currency processing system of claim 1, wherein the one or more coin receptacles includes a plurality of coin bags, each of the coin bags being individually removable from the housing.

15. The currency processing system of claim 14, wherein a bag inlet height of at least one of the coin bags is at least approximately 30 inches.

16. The currency processing system of claim 1, wherein the rotatable disk includes an upper surface adjacent the lower surface of the sorting head, the upper surface having a compressible pad configured to press coins upwardly against the lower surface of the sorting head as the rotatable disk rotates.

17. The currency processing system of claim 1, further comprising a coin tray mounted to the housing, the coin tray being configured to receive a batch of coins and feed the batch of coins into the housing through the coin input area.

18. The currency processing system of claim 17, wherein a height of the coin hopper is approximately 36 to 42 inches.

19. The currency processing system of claim 1, wherein each of the shaped regions is an individually shaped exit channel, each of the exit channels being configured to guide respective ones of the coins with a respective common diameter.

20. The currency processing system of claim 1, wherein the one or more coin receptacles consists generally of a single linear row of coin receptacles removably stored inside the housing, the housing including a door through which the coin receptacles are accessible and individually removable from the housing, and wherein the coin receptacles are aligned immediately adjacent one another and generally parallel to and adjacent the door of the housing.

21. The currency processing system of claim 20, further comprising a plurality of coin chutes connected to the disk-type coin processing unit and each configured to receive coins from a respective one of the exit stations and direct coins, under the force of gravity, into a respective one of the coin receptacles, wherein each of the coin chutes has a distinct length and a distinct inlet height.

22. The currency processing system of claim 21, wherein at least one of the exit stations is a top-most exit station located at the top of the singular sorting head, at least one of the coin chutes extending to the top-most exit station.

23. The currency processing system of claim 20, wherein the row of coin receptacles includes coin bags, each of the coin bags being removably mounted inside the housing at a distinct height.

24. The currency processing system of claim 1, further comprising an angled support plate rigidly mounting the disk-type coin processing unit inside the housing.

25. A coin processing machine comprising:

a housing configured to rest on a support surface, the housing including a coin input area configured to receive therethrough a batch of coins;

a plurality of coin receptacles stowed inside the housing, each of the coin receptacles being individually removable from the housing; and a disk-type coin processing unit disposed at least partially inside the housing and operatively coupled to the coin input area and the plurality of coin receptacles, the coin processing unit including:

one and only one rotatable disk configured to receive coins from the coin input area of the housing, support the coins on an upper surface thereof, and impart motion to the coins received from the coin input area, and one and only one stationary sorting head having a diametrically central opening, through which the coins are received by the coin processing unit from the coin input area of the housing, and a lower surface, which is generally parallel to and spaced slightly apart from the rotatable disk, the lower surface forming a plurality of exit channels configured to guide the coins, under the motion imparted by the rotatable disk, to a plurality of exit stations through which the coins are discharged from the coin processing unit to the plurality of coin receptacles, wherein the upper surface of the rotatable disk and the lower surface and central opening of the stationary sorting head are obliquely angled with respect to the support surface upon which the housing rests.

26. The coin processing machine of claim 25, further comprising a coin hopper configured to receive the coins directly from the coin input area of the housing and feed the coins directly into the rotatable disk and sorting head.

27. The coin processing machine of claim 26, wherein the upper surface of the rotatable disk and the lower surface of the sorting head are obliquely angled at least approximately 15 degrees with respect to the support surface.

28. The coin processing machine of claim 26, wherein the upper surface of the rotatable disk and the lower surface of the sorting head are obliquely angled at least approximately 10 degrees, but less than approximately 45 degrees, with respect to the support surface.

29. The coin processing machine of claim 26, further comprising a coin manifold with a plurality of chutes, each of the chutes being configured to receive coins from a respective one of the exit stations and direct coins, under the force of gravity, into a respective one of the coin receptacles.

30. The coin processing machine of claim 29, wherein each of the chutes has a respective coin inlet through which coins are received from the respective exit station, two or more of the coin inlets of the chutes having different respective inlet heights.

31. The coin processing machine of claim 29, wherein each of the chutes has a respective elongated tubular body, two or more of the tubular bodies having different respective throw angles with respect to the support surface upon which the housing rests.

32. The coin processing machine of claim 29, wherein the plurality of chutes each has a respective throw angle of at least approximately 20 degrees with respect to the support surface upon which the housing rests.

33. The coin processing machine of claim 26, wherein the plurality of coin receptacles are stowed side-by-side inside the housing in a generally linear fashion.

34. The coin processing machine of claim 26, wherein the plurality of coin receptacles includes a plurality of coin bags, each of the coin bags being individually removable from the housing.

35. A coin processing machine for sorting batches of coins which include coins of mixed diameters, the coin processing machine comprising:

a housing configured to rest on a planar horizontally oriented support surface, the housing including a coin input area configured to receive coins therethrough, the housing further including a door through which is accessible the inside of the housing;

a coin tray mounted to the housing, the coin tray being configured to receive a batch of coins from a user and feed the batch of coins into the housing through the coin input area;

a row of coin bags removably mounted side-by-side inside the housing in a generally linear fashion generally parallel to the door of the housing, each of the coin bags being individually removable from the housing;

a coin manifold with a plurality of chutes, each of the chutes being configured to direct coins, under the force of gravity, into a respective one of the coin bags;

a hopper configured to receive the batch of coins directly from the coin tray through the coin input area of the housing;

one and only one rotatable disk having a resilient top surface for supporting thereon coins received from the hopper, the rotatable disk being configured to impart motion to the coins on the resilient top surface;

a motor configured to selectively rotate the rotatable disk; and one and only one stationary sorting head having a diametrically central opening, through which coins are received directly from the hopper, and a lower surface, which is substantially parallel to and spaced slightly from the resilient top surface of the rotatable disk, the lower surface forming a plurality of individually shaped exit channels, each of the exit channels being configured to guide respective ones of the coins with a respective common diameter, under the motion imparted by the rotatable disk, to a respective one of a plurality of exit stations through which the coins are discharged to a respective one of the coin bags via a respective one of the chutes, wherein the resilient top surface of the rotatable disk and the lower surface and central opening of the stationary sorting head are obliquely angled at least approximately 10 degrees with respect to the support surface upon which the housing rests.

* * * * *